US008473090B2

(12) United States Patent
Yamada

(10) Patent No.: US 8,473,090 B2
(45) Date of Patent: Jun. 25, 2013

(54) EMBROIDERY DATA CREATION APPARATUS AND NON-TRANSITORY COMPUTER-READABLE MEDIUM STORING EMBROIDERY DATA CREATION PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 93 days.

(21) Appl. No.: 13/285,764

(22) Filed: Oct. 31, 2011

(65) Prior Publication Data

US 2012/0116569 A1 May 10, 2012

(30) Foreign Application Priority Data

Nov. 10, 2010 (JP) ..... 2010-251374

(51) Int. Cl.
*D05C 5/02* (2006.01)

(52) U.S. Cl.
USPC ..... 700/138; 112/470.01

(58) Field of Classification Search
USPC ..... 700/136–138; 112/102.5, 445, 470.01, 112/470.04, 470.06, 470.09, 475.18, 475.19
See application file for complete search history.

(56) References Cited

U.S. PATENT DOCUMENTS

| | | | | |
|---|---|---|---|---|
| 5,343,401 | A * | 8/1994 | Goldberg et al. | 700/138 |
| 5,839,380 | A * | 11/1998 | Muto | 112/102.5 |
| 5,960,726 | A * | 10/1999 | Yamada | 112/102.5 |
| 6,324,441 | B1 * | 11/2001 | Yamada | 700/138 |
| 6,629,015 | B2 * | 9/2003 | Yamada | 700/138 |
| 2002/0038162 | A1 | 3/2002 | Yamada | |
| 2007/0233309 | A1 * | 10/2007 | Yamada | 700/138 |
| 2007/0233310 | A1 * | 10/2007 | Yamada | 700/138 |

FOREIGN PATENT DOCUMENTS

JP A-2001-259268 9/2001

* cited by examiner

*Primary Examiner* — Nathan Durham
(74) *Attorney, Agent, or Firm* — Oliff & Berridge, PLC

(57) ABSTRACT

An embroidery data creation apparatus includes a first dividing portion that divides an entire area of an image into a first area and a second area based on one of frequency components and angle characteristics, a first data creation portion including a number of partitions setting portion, a second dividing portion that divides the first area into color areas, a representative angle computing portion that computes representative angles for the color areas, a first line segment arranging portion that arranges first line segments in each of the color areas, a first line segment color setting portion that sets first line segment colors, and a first line segment connecting portion that creates first data by connecting the first line segments, a second data creation portion that creates second data, and an embroidery data creation portion that creates embroidery data by combining the first data and the second data.

16 Claims, 29 Drawing Sheets

FIG. 7

| | | |
|---|---|---|
| 45 (10) | 45 (20) | 50 (30) |
| 45 (20) | 50 (35) | 50 (20) |
| 50 (30) | 50 (20) | 55 (10) |

FIG. 20

| | | |
|---|---|---|
| AREA 1 (RED) | AREA 2 (PURPLE) | AREA 3 (BLUE) |

EMBROIDERY DATA CREATION APPARATUS AND NON-TRANSITORY COMPUTER-READABLE MEDIUM STORING EMBROIDERY DATA CREATION PROGRAM

CROSS-REFERENCE TO RELATED APPLICATION

This application claims priority to Japanese Patent Application No. 2010-251374, filed on Nov. 10, 2010, the disclosure of which is hereby incorporated by reference in its entirety.

BACKGROUND

The present disclosure relates to an embroidery data creation apparatus that creates embroidery data for the performing of embroidery sewing by a sewing machine that is capable of embroidery sewing, and to a non-transitory computer-readable medium that stores an embroidery data creation program.

An embroidery data creation apparatus is known that creates embroidery data for the performing of embroidery sewing, by a sewing machine that is capable of embroidery sewing, of a pattern that is based on data of an image such as a photograph or the like. The embroidery data may be created by the procedure hereinafter described, for example. First, angle characteristics for various parts of the image, and strengths of the angle characteristics, are computed based on image data that have been acquired from an image that has been read by an image scanner. Line segments are arranged in accordance with the angle characteristics and their strengths. The angle characteristic is information that indicates a direction in which the continuity of a color is high. The strength of the angle characteristic is information that indicates a magnitude of change in the color. Next, the various line segments are colored by a limited number of thread colors, such that they reflect the colors of the original image, and the line segments of the same color are connected. Then the embroidery data are created by converting the data that indicate the line segments into data that indicate stitches.

SUMMARY

In the procedure that is described above, when the line segments are arranged, priority is given to the angle characteristics with high strengths in order to prevent irregularities in the directions of the line segments that could lead to problems in the creating of the embroidery data. The angle characteristics with high strengths are reflected in those parts having angle characteristics with the low strengths. The parts for which the strengths of the angle characteristics are high are those for which the changes in the colors are abrupt, and the parts for which the strengths of the angle characteristics are low are those for which the changes in the colors are gradual. Accordingly, cases may arise in which, for those line segments for which the changes in the colors are continuously gradual, as in a gradation, for example, the angle characteristics are not reflected in the stitches, such that unnatural stitches are formed.

Various exemplary embodiments of the general principles herein provide an embroidery data creation apparatus that creates embroidery data for forming natural stitches, even for line segments for which changes in colors are continuously gradual, and also a non-transitory computer-readable medium that stores an embroidery data creation program.

Exemplary embodiments herein provide an embroidery data creation apparatus that creates embroidery data based on image data for an image that is an aggregation of pixels. The embroidery data creation apparatus includes a first dividing portion, a first data creation portion, a second data creation portion, and an embroidery data creation portion. The first dividing portion divides an entire area of the image into a first area and a second area, based on one of frequency components and angle characteristics that make up the image. The angle characteristic is information that indicates a direction in which continuity of a color within the image is high. The first area is an area within the entire area that is not the second area. The second area is, within the entire area of the original image, one of an area that contains frequency components that are not less than a specified value and an area that has angle characteristics each having a strength that is not less than a specified value, the strength indicating a magnitude of change in a color. The first data creation portion creates first data. The first data are data that describe first stitches that are stitches to be formed in the first area. The first data creation portion includes a number of partitions setting portion, a second dividing portion, a representative angle computing portion, a first line segment arranging portion, a first line segment color setting portion, and a first line segment connecting portion. The number of partitions setting portion sets a number of partitions for dividing the first area by color. The second dividing portion divides the first area into color areas by reducing the number of colors in the first area to the number of partitions that has been set by the number of partitions setting portion, in accordance with colors of pixels that make up the first area. The representative angle computing portion computes a representative angle for each of the color areas. The representative angle is a representative angle characteristic for the color area. The first line segment arranging portion arranges first line segments in each of the color areas in accordance with the representative angle that has been computed by the representative angle computing portion. The first line segments are line segments that correspond to the first stitches. The first line segment color setting portion sets first line segment colors from among thread colors that can be used by a sewing machine. The first line segment colors are thread colors to be used for the respective first line segments. The first line segment connecting portion creates the first data by connecting the first line segments for each of the first line segment colors that have been set by the first line segment color setting portion. The second data creation portion creates second data by a method that is different from the method for creating the first data. The second data are data that describe second stitches that are stitches to be formed in the second area. The embroidery data creation portion creates embroidery data for sewing an embroidery pattern that expresses the image, by combining the first data that have been created by the first data creation portion and the second data that have been created by the second data creation portion.

Exemplary embodiments herein provide a non-transitory computer-readable medium that stores an embroidery data creation program for creating embroidery data based on image data for an image that is an aggregation of pixels. The embroidery data creation program includes instructions that, when executed, cause a computer to perform the steps of: dividing an entire area of the image into a first area and a second area, based on one of frequency components and angle characteristics that make up the image, the angle characteristic being information that indicates a direction in which continuity of a color within the image is high, the first area being an area within the entire area that is not the second area, and the second area being, within the entire area of the original image, one of an area that contains frequency components that are not less than a specified value and an area that has angle characteristics each having a strength that is not less than a specified value, the strength indicating a magnitude of change in a color; setting a number of partitions for dividing the first area by color; dividing the first area into color areas by reducing the number of colors in the first area to the number of partitions that has been set, in accordance with colors of pixels that make up the first area; computing a representative angle for each of the color areas, the representative angle being a representative angle characteristic for the color area; arranging first line segments in each of the color areas in accordance with the representative angle that has been computed, the first line segments being line segments that correspond to first stitches, the first stitches being stitches to be formed in the first area; setting first line segment colors from among thread colors that can be used by a sewing machine, the first line segment colors being thread colors to be used for the respective first line segments; creating first data by connecting the first line segments for each of the first line segment colors that have been set, the first data being data that describe the first stitches; creating second data by a method that is different from the method for creating the first data, the second data being data that describe second stitches, the second stitches being stitches to be formed in the second area; and creating, by combining the first data and the second data, embroidery data for sewing an embroidery pattern that expresses the image.

BRIEF DESCRIPTION OF THE DRAWINGS

Exemplary embodiments of the present disclosure will be described below in detail with reference to the accompanying drawing in which:

FIG. 7 is an explanatory figure that shows examples of angle characteristics and angle characteristic strengths that are computed for individual pixels;

FIG. 20 is an explanatory figure that shows an example of areas 1 to 3 that have been divided by color;

DETAILED DESCRIPTION OF THE EXEMPLARY EMBODIMENTS

First Embodiment

Figure 1:
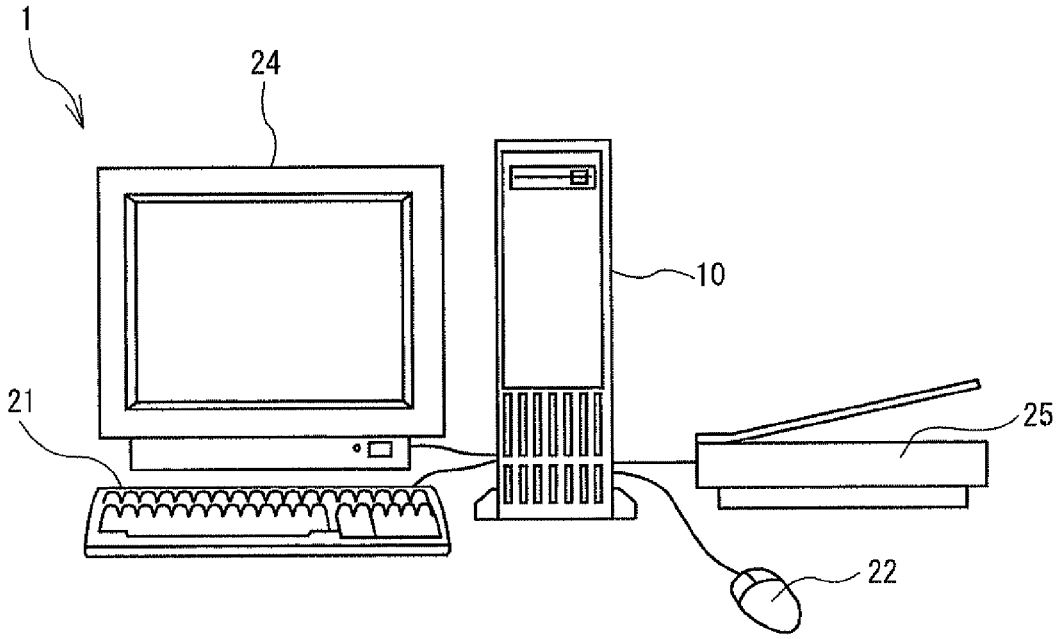
FIG. 1 is an external view of an embroidery data creation apparatus.

A first embodiment will be explained with reference to FIGS. 1 to 11. First, a configuration of an embroidery data creation apparatus 1 according to the first embodiment will be explained with reference to FIGS. 1 and 2. The embroidery data creation apparatus 1 is an apparatus that creates embroidery data that is used by a sewing machine 3 (refer to FIG. 3), which will be described later, for sewing an embroidery pattern. The embroidery data creation apparatus 1 according to the present embodiment is capable of creating embroidery data for embroidery sewing a design that is based on an image such as a photograph or the like. As shown in FIG. 1, the embroidery data creation apparatus 1 may be a general-purpose apparatus such as a personal computer or the like, for example. The embroidery data creation apparatus 1 that is shown in FIG. 1 includes a main unit 10, and a keyboard 21, a mouse 22, a display 24, and an image scanner 25 that are connected to the main unit 10. An image that serves as a basis for creating the embroidery data in the present embodiment, may be read into the embroidery data creation apparatus 1 through the image scanner 25, for example.

Figure 2:
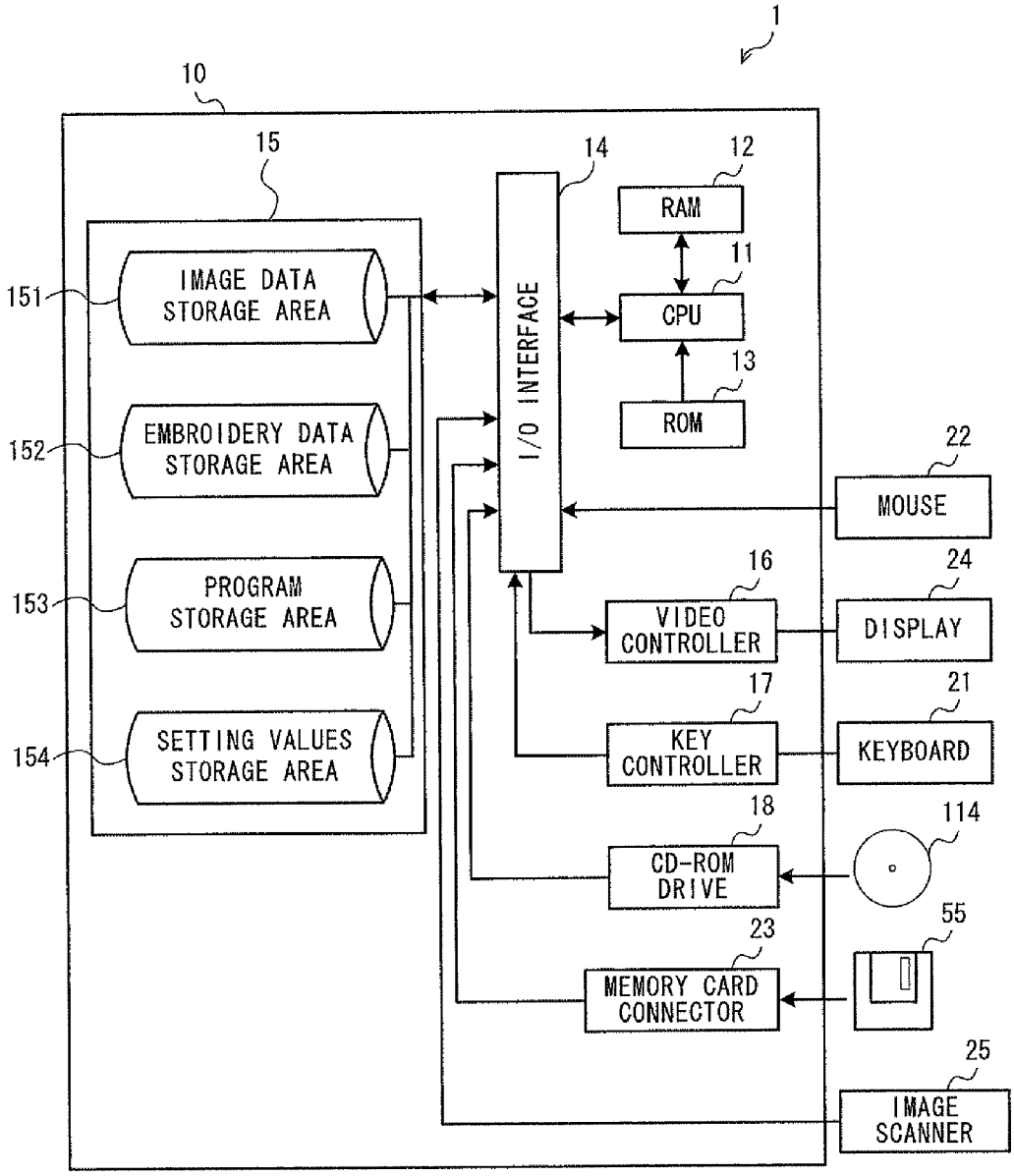
FIG. 2 is a block diagram that shows an electrical configuration of the embroidery data creation apparatus.

An electrical configuration of the embroidery data creation apparatus 1 will be explained with reference to FIG. 2. As shown in FIG. 2, the embroidery data creation apparatus 1 includes a CPU 11 that is a controller that performs control of the embroidery data creation apparatus 1. A RAM 12 that temporarily stores various types of data, a ROM 13 in which a BIOS and the like are stored, and an input/output (I/O) interface 14 that performs mediation of data transfers are connected to the CPU 11. A hard disk device (HDD) 15, a mouse 22 that is an input device, a video controller 16, a key controller 17, a CD-ROM drive 18, a memory card connector 23, and an image scanner 25 are connected to the I/O interface 14. The embroidery data creation apparatus 1 may also include an external interface for connecting to an external device or a network, although this is not shown in FIG. 2.

The HDD 15 has a plurality of storage areas that include an image data storage area 151, an embroidery data storage area 152, a program storage area 153, and a setting values storage area 154. Image data for various types of images, such as the image that serves as the basis for creating the embroidery data and the like, may be stored in the image data storage area 151. The embroidery data that are created by embroidery data creation processing according to the present embodiment may be stored in the embroidery data storage area 152. Programs for various types of processing that are performed by the embroidery data creation apparatus 1, such as an embroidery data creation program and the like that will be described later, may be stored in the program storage area 153. Various types of setting values that are used in various types of processing may be stored in the setting values storage area 154.

The display 24, which is a display device that displays information, is connected to the video controller 16. The keyboard 21, which is an input device, is connected to the key controller 17. A CD-ROM 114 can be inserted into the CD-ROM drive 18. For example, when the embroidery data creation program is set up, the CD-ROM 114, which stored the embroidery data creation program, may be inserted into the CD-ROM drive 18. Then the embroidery data creation program may be read and is stored in the program storage area 153 of the HDD 15. A memory card 55 can be connected to the memory card connector 23, and information can be read from and written to the memory card 55.

Figure 3:
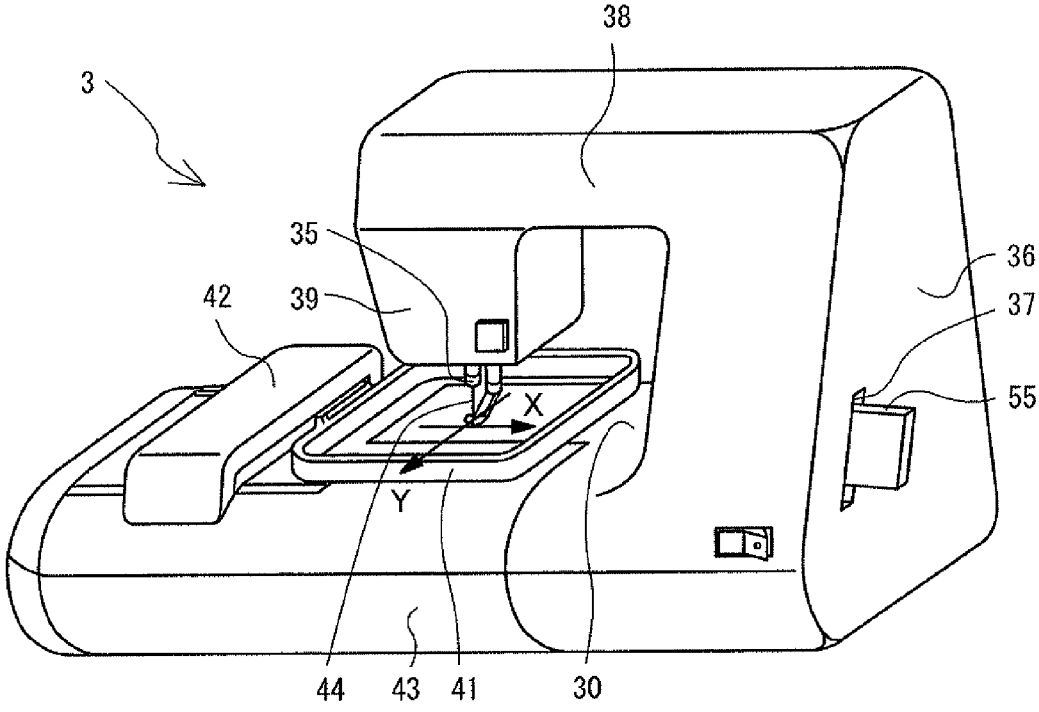
FIG. 3 is an external view of a sewing machine.

The sewing machine 3, which is capable of sewing an embroidery pattern based on the embroidery data that have been created by the embroidery data creation apparatus 1, will be briefly explained with reference to FIG. 3. As shown in FIG. 3, the sewing machine 3 includes a bed portion 30, a pillar portion 36, an arm portion 38, and a head portion 39. The bed portion 30 is the base of the sewing machine 3 and is long in the left-right direction in relation to the person doing the sewing. The pillar portion 36 extends upward from the right end portion of the bed portion 30. The arm portion 38 extends to the left from the upper end of the pillar portion 36 such that it is positioned opposite the bed portion 30. The head portion 39 is a portion that is joined to the left end of the arm portion 38. An embroidery frame 41 that holds a work cloth on which embroidering is performed can be disposed above the bed portion 30.

During embroidery sewing, the embroidery frame 41 is moved by a Y direction drive portion 42 that is disposed above the bed portion 30 and by an X direction drive mechanism (not shown in the drawings) that is contained in a body case 43 to a needle drop point that is indicated by an internal XY coordinate system of the sewing machine 3. In conjunction with the moving of the embroidery frame 41, a shuttle mechanism (not shown in the drawings) and a needle bar 35 on which a sewing needle 44 is mounted are operated. The embroidery pattern is thus formed on the work cloth by the operation. The Y direction drive portion 42, the X direction drive mechanism, the needle bar 35, and the like are controlled based on the embroidery data by a control device (not shown in the drawings) that is built into the sewing machine 3 and contains a microcomputer or the like.

A memory card slot 37 through which the memory card 55 can be inserted and removed is provided on a side face of the pillar portion 36 of the sewing machine 3. The embroidery data that have been created by the embroidery data creation apparatus 1, for example, may be stored in the memory card 55 through the memory card connector 23. Then the memory card 55 may be inserted in the memory card slot 37 of the sewing machine 3, the embroidery data that are stored in the memory card 55 may be read, and the embroidery data may be stored in the sewing machine 3. The control device (not shown in the drawings) of the sewing machine 3 can control the operation of the sewing of the embroidery pattern by the elements that are described above, based on the embroidery data that have been read from the memory card 55. Thus the embroidery pattern can be sewn using the sewing machine 3 based on the embroidery data that have been created by the embroidery data creation apparatus 1.

The embroidery data creation processing that is performed by the embroidery data creation apparatus 1 according to the first embodiment will be explained with reference to FIGS. 4 to 7. The embroidery data creation processing is started when the embroidery data creation program that is stored in the program storage area 153 of the HDD 15 is activated, and it is performed by the executing of the program by the CPU 11.

Figure 4:
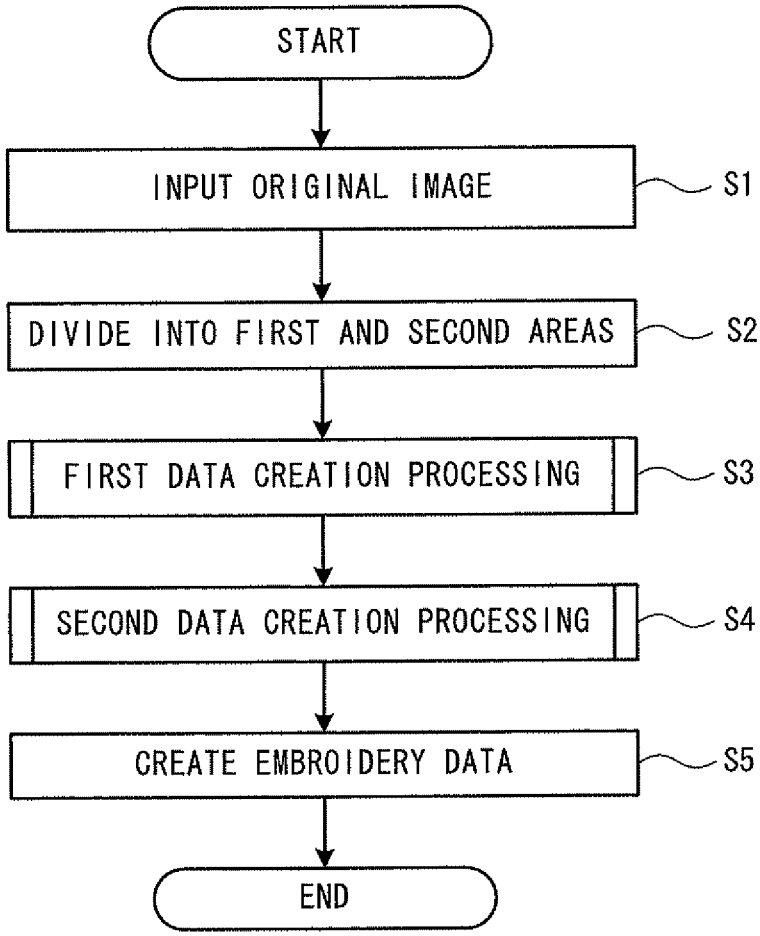
FIG. 4 is a flowchart of embroidery data creation processing according to a first embodiment.

As shown in FIG. 4, first, the image data for the image that serves as the basis for creating the embroidery data (hereinafter called the original image) are input to the embroidery data creation apparatus 1 (Step S1). There are no particular restrictions on the method for inputting the image data, but image data that have been acquired by using the image scanner 25 to scan a photograph or a design, for example, may be used. In addition, image data that have been stored in advance in the image data storage area 151 of the HDD 15 or image data that have been stored in an external storage medium such as the CD-ROM 114, the memory card 55, a CD-R, or the like may also be input.

Next, based on the image data that have been input, the entire area of the original image is divided into a first area and a second area (Step S2). In the present embodiment, the second area is an area, within the entire area of the original image, that contains frequency components (hereinafter called the high-frequency components) that are not less than a specified value. The first area is an area within the entire area of the original image that is not the second area. The frequency components that are contained in the original image indicate, in the form of the frequency components, differences among attribute values that pertain to colors in the original image. The frequency component of any one of the plurality of the pixels that make up the original image becomes higher as the differences between the attribute values for the pixel and the attribute values for the adjacent pixels become greater. Here, the attribute values that pertain to the colors may be values that can describe the pixel in terms of the three values of red (R), green (G), and blue (B) (hereinafter called the RGB values). In this case, the difference in the attribute values may be equivalent to a space distance (hereinafter also simply called the distance) in an RGB space coordinate system that is expressed by the coordinates (R, G, B).

At Step S2, the area that is identified as the second area that contains the high-frequency components is the area that is made up of those pixels, among the plurality of the pixels that make up the original image, for which the attribute values that pertain to the colors differ from the attribute values for the adjacent pixels by not less than the specified value. The identifying of the area can be achieved by a known method that uses a high-pass filter such as a Laplacian filter or the like. The entire area of the original image except for the second area is specified as the first area. In this manner, the first area, where the change in the color is comparatively gradual, and the second area, where the change in the color is comparatively abrupt, can be derived by dividing up the entire area of the original image based on the magnitudes of the differences in the attribute values from those of the adjacent pixels. The data that indicate the pixels that are contained in the first area and the pixels that are contained in the second area are stored in the RAM 12.

Figure 5:
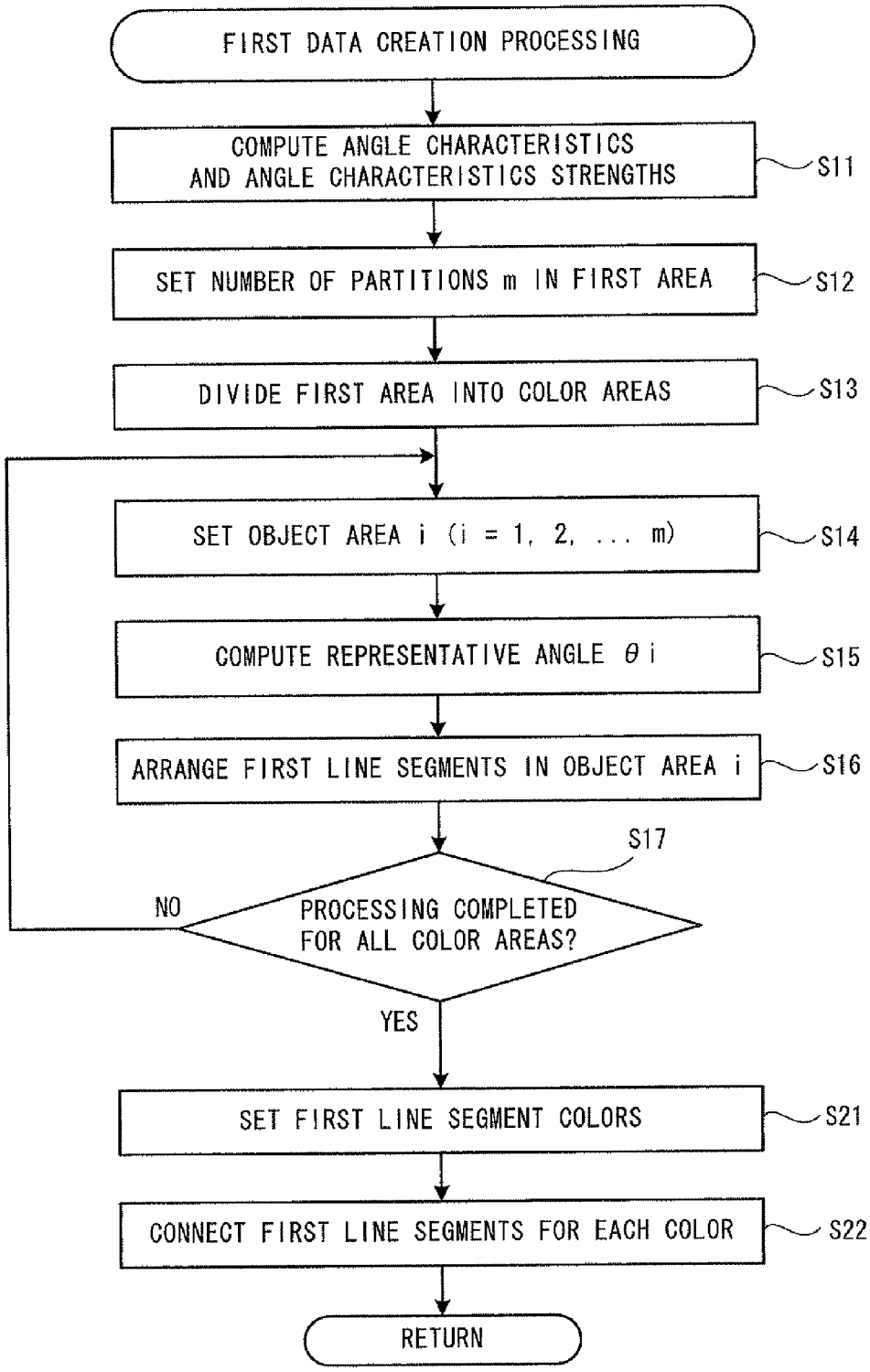
FIG. 5 is a flowchart of first data creation processing that is performed by the embroidery data creation processing.

Next, first data creation processing (Step S3) is performed that creates first data, which are data that describe stitches (hereinafter called the first stitches) that will be formed by the embroidery sewing in the first area. The first data creation processing will be explained in detail with reference to FIG. 5. As shown in FIG. 5, first, an angle characteristic and a strength of the angle characteristic are computed for each of the pixels that make up the first area (Step S11). The angle characteristic is information that indicates a direction in which the continuity of the color of the pixel within the image is high. The strength of the angle characteristic is information that indicates the magnitude of the change in the color.

The angle characteristic and the strength of the angle characteristic can be computed using, for example, the method that is described in detail in Japanese Laid-Open Patent Publication No. 2001-259268, the relevant portions of which are incorporated herein by reference. Accordingly, a detailed explanation will be omitted here, and only an overview will be explained. One of the pixels that make up the first area is designated as an object pixel, and an object area is defined as the object pixel and a specified number of the pixels that surround the object pixel. Based on the attribute values (for example, the brightness values) that pertain to the colors of the individual pixels within the object area, a direction in which the continuity of the color in the object area is high is specified, and the angle characteristic of the object pixel is specified. A value is computed that indicates the magnitude of the change in the color within the object area, and that value is defined as the strength of the angle characteristic for the object pixel. The processing that computes the angle characteristic and the strength of the angle characteristic in this manner is performed sequentially for all of the pixels that make up the first area. Data that indicate the angle characteristic and the strength of the angle characteristic for each pixel are stored in a specified storage area of the RAM 12. The angle characteristic and the strength of the angle characteristic may also be computed using a Prewitt operator or a Sobel operator, instead of by the method described above.

A number of partitions m is set (Step S12). The number of partitions m is an integer that is not less than 2 that is to be used for reducing the number of colors in the first area and dividing the first area into a plurality of color areas. In principle, the number of partitions m is not dependent on the number of the thread colors to be used for the embroidery sewing. However, realistically, if the difference between the number of partitions in and the number of the thread colors to be used is especially large, the thread colors to be used and the colors of the color areas may be significantly different. Accordingly, it may be desirable for the difference between the number of partitions m and the number of the thread colors to be used to be small. A number that is input by a user from the keyboard 21 or the like, for example, may be used as the number of partitions m, and a number that is computed in accordance with the number of the thread colors to be used may also be used as the number of partitions m.

The first area is divided into m color areas, each of which has a different color, by reducing the number of colors in the first area to m colors, in accordance with the number of partitions m that has been set (Step S13). For example, m representative colors for the first area may be set using the median cut method or the like. The in color areas can be defined by converting each of the individual attribute values of a plurality of the pixels that are contained in the first area into an attribute value of one of the representative colors that is the closest to one another among the m colors. A number from 1 to in is assigned to each of the color areas. The number of each color area, the representative color that corresponds to the color area, and the data that indicate the pixels that are contained in the color area are associated with one another and are stored in the RAM 12.

For each of the m color areas that have been defined, processing is sequentially performed that computes a representative angle and arranges first line segments (Steps S14 to S17). The first line segments are line segments that correspond to the first stitches that will be formed in the first area. First, an object area i is set that is the color area that is the object of the processing (Step S14). i is a variable that is stored in the RAM 12 for sequentially processing the color areas from 1 to m. In the first round of the processing, the variable i is set to an initial value of 1. That is, the color area to which the number 1 has been assigned is set as the object area. Next, a representative angle θi, which is an angle that is indicated by a representative angle characteristic of the object area i, is computed based on the angle characteristics and the strengths of the angle characteristics that were computed at Step S11 (Step S15). The computed representative angle θi is stored in the RAM 12 in association with the color area with the number i. For example, the angle characteristic for which the strength is the greatest within the object area i may be used as the representative angle θi. The angle characteristics for all of the pixels within the object area i may also be weighted by their strengths, the average value may be computed, and the average value may be used as the representative angle θi.

For example, at Step S11, for each of the pixels that make up the object area i, the angle characteristics and the strengths of the angle characteristics that are shown in FIG. 7 are computed. In FIG. 7, each of the rectangular areas indicates a pixel, with the upper numerical value indicating the angle characteristic and the lower numerical value in parentheses indicating the strength of the angle characteristic. In the example in FIG. 7, among the nine pixels, the strength 35 of the angle characteristic for the pixel in the center is the greatest. Accordingly, in a case where the angle characteristic with the greatest strength is used, the 50 degrees that is indicated by the angle characteristic 50 of the pixel in the center can be used as the representative angle θi. Note that the angle that is indicated by the angle characteristic, the angle of the representative angle, and the like are expressed using the rightward direction in FIG. 7 as zero degrees, with the counterclockwise direction being positive and the clockwise direction being negative. The other drawings are the same.

In a case where the average value of the angle characteristics is used after the angle characteristics have been weighted by their strengths, the representative angle θi can be computed as described below. First, a value dX and a value dY are derived, dX being the sum of the numerical values that are computed by multiplying the cosine value for the angle characteristic for each pixel by the strength of the angle characteristic, and dY being the sum of the numerical values that are computed by multiplying the sine value for the angle characteristic for each pixel by the strength of the angle characteristic. In the example in FIG. 7, the values 128 and 147 are derived for dX and dY, respectively, by the formulas that are shown below.

$$dX=\cos(45)\times10+\cos(45)\times20+\cos(50)\times30+\cos(45)\times20+\cos(50)\times35+\cos(50)\times20+\cos(50)\times30+\cos(50)\times20+\cos(55)\times10\approx128$$

$$dY=\sin(45)\times10+\sin(45)\times20+\sin(50)\times30+\sin(45)\times20+\sin(50)\times35+\sin(50)\times20+\sin(50)\times30+\sin(50)\times20+\sin(55)\times10\approx147$$

The arctangent of the value of dY/dX is derived and is used as the representative angle θi. In the example in FIG. 7, 49 degrees is derived as the representative angle θi by the formula below.

$$a\tan(dY/dX)\approx49(\text{degrees})$$

Note that in a case where a given pixel is adjacent to a pixel of the same color, the strength of the angle characteristic for that pixel is zero. In this case, the average value of the angle characteristics that are simply weighted by their strengths is computed as zero degrees. However, the angle characteristic for that portion is actually not zero; it is just that the pixel has no angle. Accordingly, the pixel for which the strength of the angle characteristic is zero may be excluded from the computation of the average value that is described above. In a case where all of the pixels in the object area have no angle characteristics, the representative angle θi for that object area i is not zero, but may be defined as "none". In a case where the representative angle θi is defined as "none", one of a value that is set in advance and a value that is set by user input may be used as the representative angle θi.

After the representative angle θi for the object area i is computed as described above, the processing is performed that arranges the first line segments within the object area i in accordance with the representative angle θi (Step S16). More specifically, the first line segments that extend in the direction that is indicated by the representative angle θi are arranged parallel to one another within the object area i at equal intervals according to a thread density that is set in advance. Both ends of each of the first line segments are set on the boundary lines of the object area i, such that when the first stitches that correspond to the first line segments are formed, the object area i is completely covered by the first stitches. Data that indicate the positions (the coordinates) of both ends of each of the first line segments are stored in the RAM 12. The arranging of the first line segments in this manner in accordance with the single representative angle θi for all of the pixels within a given color area is based on the following concept. First of all, the first area is an area in which the change in the color is comparatively gradual, and that has been identified based on the frequency components, so it is specified as an area in which the strengths of angle characteristics are weak. Therefore, there may be no problem even if the entire color area is unified by a single angle characteristic.

A determination is made as to whether the processing has been completed for all of the color areas within the first area (Step S17). The color areas have been defined by dividing the first area into the number of partitions m. Accordingly, a determination is made as to whether the variable i has become equal to the number of partitions m. In a case where the variable i is less than the number of partitions in, that is, where a color area exists that has not yet been set as the object area i (NO at Step S17), the processing returns to Step S14. The variable i is incremented by 1, the color area to which the next number has been assigned is set as the next object area i, and the same processing that is described above is performed.

If the processing has been completed for all of the color areas (YES at Step S17), processing is performed that sets first line segment colors (Step S21). The first line segment colors are the colors of the threads that will be used for sewing the first stitches that respectively correspond to the first line segments that have been arranged in each of the color areas. Any known method may be used as the method for setting the first line segment colors. For example, the first line segment color for all of the first line segments that have been arranged within a given color area may be set to the color, among the plurality of the thread colors that can be used for the embroidery sewing by the sewing machine 3, that is closest to the representative color of the color area. This means that all of the first line segments in the same color area will be sewn with the same color of thread.

To be specific, the space distance in the RGB space between the RGB values for the individual thread colors and the RGB values for the representative color for the color area is derived. The thread color for which the derived distance is the shortest may be set as the first line segment color for all of the first line segments that have been arranged in the color area. Note that in a case where the RGB values for a given thread color are defined as (Rt, Gt, Bt) and the RGB values for the representative color of a given color area are defined as (Ra, Ga, Ba), the space distance d is derived by the formula below.

$$d=\sqrt{\{(Rt-Ra)^2+(Gt-Ga)^2+(Bt-Ba)^2\}}$$

Data that indicate the first line segments and the corresponding first line segment colors are stored in the RAM 12.

Processing is performed that creates the first data by successively connecting the first line segments for each of the first line segment colors (Step S22). For example, first, the first line segment that is closest to the left edge of a given color area may be defined as the first line segment that is the first in the connection order. One of the two endpoints of the line segment is defined as a starting point, and the other endpoint is defined as an ending point. Next, among the other first line segments of the same first line segment color, the first line segment that has an endpoint that is the closest to the ending point of the first first line segment is defined as the second first line segment, to which the first first line segment will be connected. In the same manner, the endpoint of one of the first line segments of the same first line segment color that is most closely positioned is successively connected to the ending point of the first line segment that has already been connected. Then all of the first line segments are connected by taking the groups of the first line segments that have been connected for each of the first line segment colors and connecting them at the nearest endpoints. The first data are then created. The first data are data that indicate the positions (the coordinates) of the endpoints of all of the first line segments that have been connected, the connection order, and the first line segment colors.

As described previously, in the present embodiment, the first line segments within the same color area are lined up parallel to one another at equal intervals, and the endpoints of each of the first line segments are set on the boundary lines of the color area. Furthermore, the first line segments within the same color area are all the same color, so the first data can easily be created simply by connecting the endpoints of the first line segments that have been arranged within the color area in the order in which they have been lined up. Once the first data have been created in this manner, the first data creation processing that is shown in FIG. 5 is terminated, and the processing returns to the embroidery data creation processing that is shown in FIG. 4.

Figure 6:
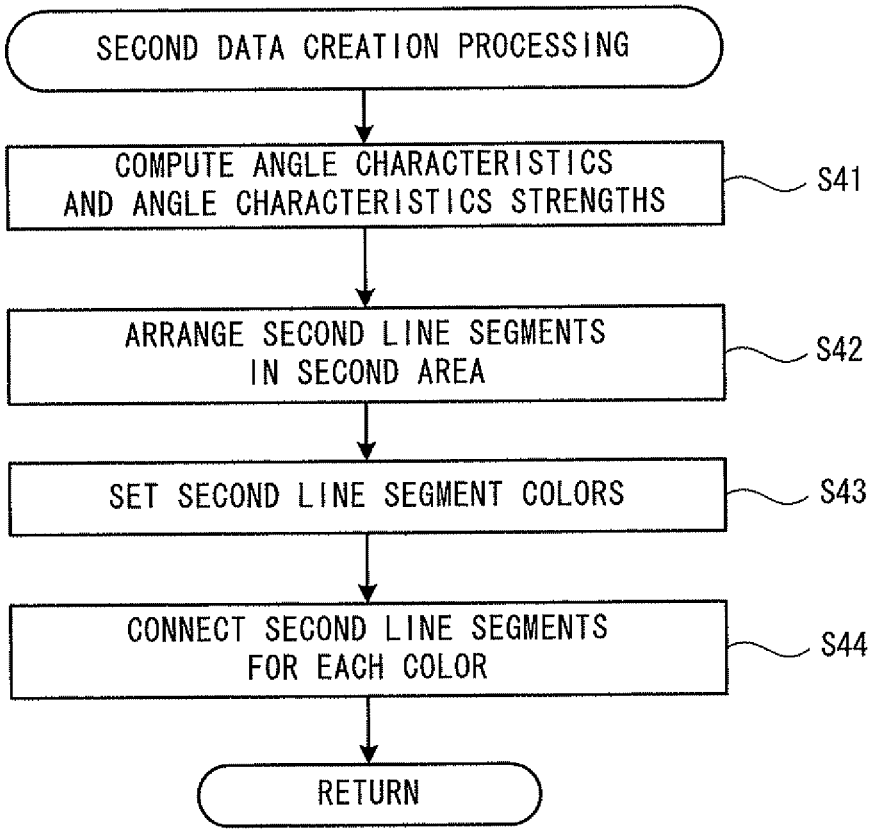
FIG. 6 is a flowchart of second data creation processing that is performed by the embroidery data creation processing.

As shown in FIG. 4, next, second data creation processing (Step S4) is performed that creates second data, which are data that indicate the stitches (hereinafter called the second stitches) that are formed in the second area by the embroidery sewing by the sewing machine 3. The second data are created by a method that is different from the method for creating the first data that is described above. The second data creation processing will be explained in detail with reference to FIG. 6. As shown in FIG. 6, first, the angle characteristic and the strength of the angle characteristic are computed for each of the pixels that make up the second area (Step S41). The method for computing the angle characteristic and the strength of the angle characteristic is the same as in the processing at Step S11 in the first data creation processing (refer to FIG. 5), so an explanation will be omitted here.

Next, processing is performed that arranges second line segments within the second area (Step S42). The second line segments are line segments that correspond to the second stitches that will be formed in the second area. Then the colors of the threads that will be used for each of the second line segments (hereinafter called the second line segment colors) are set (Step S43), and processing is performed that creates the second data by successively connecting the second line segments for each of the second line segment colors (Step S44). In the present embodiment, the processing at Steps S42 to S44 is performed using the method that is described in detail in Japanese Laid-Open Patent Publication No. 2001-259268, the relevant portions of which are incorporated herein by reference. Accordingly, a detailed explanation will be omitted here, and only an overview will be explained.

At Step S42, the second line segments, which have lengths that are set in advance and which extend in the direction that is indicated by the angle characteristic that was computed at Step S41, are arranged such that the center of each of the second line segments is positioned at each of the pixels that make up the second area. However, the second line segments are created only for those pixels, among the plurality of the pixels that make up the second area, for which the strengths of the angle characteristics that were computed at Step S41 are greater than a specified threshold value. In contrast, for those pixels for which the strengths of the angle characteristics are not greater than the threshold value, the second line segments are arranged based on new angle characteristics that are computed by taking into account the angle characteristics of the surrounding pixels. However, as described previously, the second area is an area in which the change in the color is relatively abrupt, that is, an area in which the angle characteristics are strong. Accordingly, it is likely that, for almost all of the pixels, the second line segments will be created based on the original angle characteristics.

At Step S43, the processing hereinafter described is performed, with each of the plurality of the pixels that make up the second area being successively defined as the object pixel. First, in the original image, a specified range that has the object pixel at its center is set as a range (a reference area) in which the colors of the original image are referenced. The color of the second line segment that corresponds to the object pixel is set such that the average value of the colors that have already been set for the line segments that have been arranged in an area that is the same size as the reference area and that has the object pixel at its center is equal to the average value of the colors within the reference area in the original image. In other words, the colors of the individual second line segments are set based on the colors of the original image and on the colors of the line segments that have already been set.

The colors of the threads that will be used for sewing the second stitches that correspond to the second line segments, that is, the second line segment colors, are set based on the colors of the second line segments that have been set. For example, the second line segment colors may be set to the colors, among the plurality of the thread colors that can be used for the embroidery sewing, that are closest to the colors of the second line segments that have been set. To be specific, the space distances in the RGB space between the RGB values for the individual thread colors and the RGB values for the colors of the second line segments that have been set are derived. The thread colors for which the derived distances are the shortest may be set as the second line segment colors. The method for computing the distances is as described above for the setting of the first line segment color.

At Step S44, processing is performed that creates the second data by successively connecting the second line segments for each of the second line segment colors. In the same manner as with the first line segments, the endpoint of one of the second line segments of the same second line segment color that is most closely positioned is successively connected to the ending point of the second line segment that has already been connected. Then all of the second line segments are connected by taking the groups of the second line segments that have been connected for each of the second line segment colors and connecting them at the nearest endpoints. The second data are then created. The second data are data that indicate the positions (the coordinates) of the endpoints of all of the second line segments that have been connected, the connection order, and the second line segment colors. Once the second data have been created in this manner, the second data creation processing that is shown in FIG. 6 is terminated, and the processing returns to the embroidery data creation processing that is shown in FIG. 4.

As shown in FIG. 4, in the embroidery data creation processing, next, the final embroidery data for sewing the embroidery pattern that portrays the original image are created by combining the first data and the second data (Step S5). In the present embodiment, the data sequences of the second data are linked after the data sequences of the first data, such that the second stitches in the second area will be sewn after the first stitches in the first area. Then the coordinates of the endpoints of the first line segments and the second line segments are converted to coordinates in the internal coordinate system of the sewing machine 3, and the embroidery data are created that indicate the needle drop points, the sewing order, and the thread colors. Once the creation of the embroidery data has been completed, the embroidery data creation processing that is shown in FIG. 4 is terminated.

Figure 8:
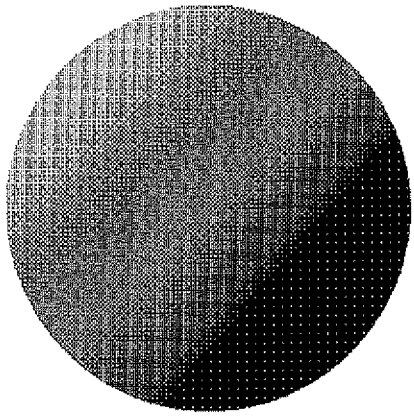
FIG. 8 is a figure that shows an example of an original image.
Figure 9:
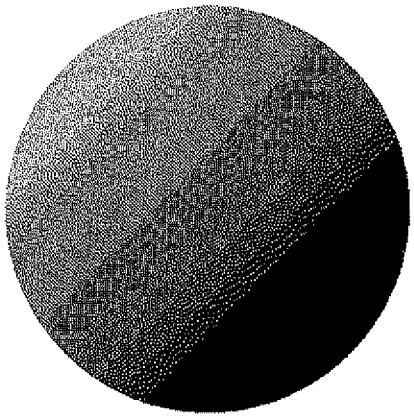
FIG. 9 is a figure that shows a state in which a first area of the original image in FIG. 8 has been divided into sixteen color areas.
Figure 10:
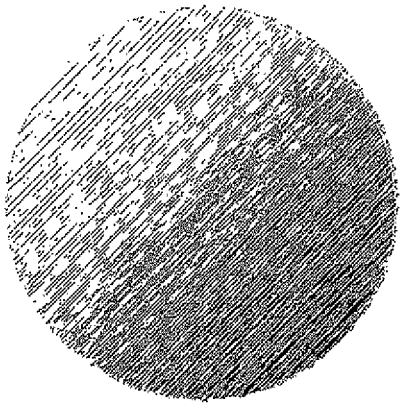
FIG. 10 is a figure that shows a sewing result of a first stitch portion based on embroidery data that have been created by the embroidery data creation processing according to the first embodiment.
Figure 11:
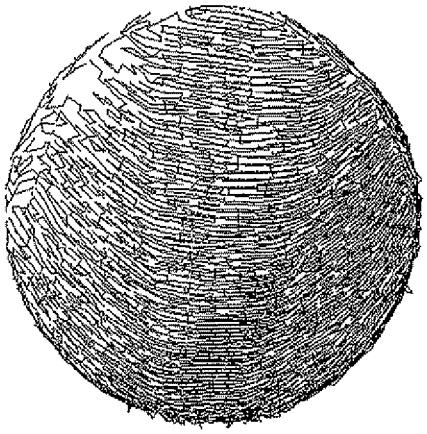
FIG. 11 is a figure that shows a sewing result that is based on embroidery data that have been created by known embroidery data creation processing.

The effect that can be obtained by the embroidery data creation processing according to the present embodiment is shown as examples in FIGS. 8 to 11. FIG. 8 shows an original image (which is actually a color image) of a circle that is colored in gradation. Once the first area in the original image has been divided into the color areas for sixteen colors, it becomes as shown in FIG. 9. Then the first line segments are arranged in each of the color areas, and the first data are created by connecting the first line segments for each of the first line segment colors. The result of the sewing that is based on the embroidery data that have been created based on the first data is as shown in FIG. 10 (only the first stitches are shown). In contrast, the result of sewing that is based on embroidery data that have been created without distinguishing between the first area and the second area, based on known embroidery data creation processing that is described in Japanese Laid-Open Patent Publication No. 2001-259268, for example, is as shown in FIG. 11. As is clear from a comparison of FIG. 10 and FIG. 11, according to the embroidery data according to the present embodiment, an embroidery pattern with a natural texture can be produced by processing as the first area the area within the circle in which the color changes continuously and gradually.

As was explained above, according to the embroidery data creation apparatus 1 according to the first embodiment, the first area, in which the color change is more gradual than in the second area, is divided into the plurality of the color areas according to the colors of the pixels, and the first line segments are arranged in accordance with the representative angle in each of the color areas. The first line segment colors for the first line segments in the first area are set to the thread colors that are the closest to the colors of the color areas, and the first data are created by connecting the first line segments of the same color. In contrast, the second data, which correspond to the second area, which is the area that includes the frequency components that are not less than the specified value and in which the color change is more abrupt than in the first area, are created by a method that is different from the method for the first data. Specifically, the second line segments are arranged based on the angle characteristic and the strength of the angle characteristic for each pixel, the second line segment colors are set based on the colors of the original image, and the second data are created by connecting the second line segments of the same color. Then the embroidery data for the embroidery pattern that corresponds to the original image and that will be sewn by the sewing machine 3 are created by linking the second data after the first data.

In this manner, each of the first line segments and the second line segments can be arranged to reflect appropriately the angle characteristics of the area in which it is arranged, without being influenced by the characteristics of the other area. Therefore, when the embroidery sewing is performed based on the embroidery data that have been created, an embroidery pattern with a natural texture can be produced both in the area where the change in the color is abrupt and in the area where the change in the color is continuous and gradual. In particular, in the creating of the first data, all of the first line segments within a given color area are arranged parallel to one another in accordance with the representative angle for the color area, and all of the first line segments have the same color. Accordingly, it may be extremely easy to create the first data by connecting the first line segments for each of the first line segment colors. That makes it possible to improve the sewing quality of the first stitches that are formed based on the first data. Furthermore, because the second stitches in the second area, where the change in the color is relatively abrupt, are sewn after the first stitches in the first area, where the change in the color is gradual, the demarcation between the two areas can be made clear, and the embroidery pattern can be produced with a texture that approximates the impression that is made when a human being looks at that pattern with his eyes.

Note that in the example that is described above, the frequency components that make up the image are used by the processing that divides the entire area of the original image into the first area and the second area (Step S2 in FIG. 4). As described previously, the first area is the area in which the change in the color in the original image is comparatively gradual, and the second area is the area in which the change in the color in the original image is comparatively abrupt. Therefore, the strengths of the angle characteristics may be used, instead of the frequency components, for dividing the entire area of the original image into the first area and the second area.

To be specific, first, the angle characteristics and the strengths of the angle characteristics are computed for all of the pixels that make up the original image. The methods for the computing are those that were explained in connection with Step S11 in the first data creation processing (FIG. 5) and Step S41 in the second data creation processing (FIG. 6). Then the area in which the angle characteristics are comparatively weak, having strengths that are less than the threshold value, may be defined as the first area, and the area in which the angle characteristics are comparatively strong, having strengths that are not less than the threshold value, may be defined as the second area. Either a value that has been set in advance and stored in the setting values storage area 154 or a value that the user has input may be used for the threshold value. After the original image has been divided into the first area and the second area, the first data and the second data may be created for each area in the same manner as in the example that was described above, in which the frequency components were used.

Parts in which the angle characteristics are comparatively strong is those in which the change in the color is abrupt, so these parts may be extracted as separate pixels as if they were individual points. Therefore, the first stitches may be formed by processing a wide area within the image as the first area where the angle characteristics are comparatively weak. Then the second stitches may be formed in the parts where the angle characteristics are strong. Thus the area where the change in the color is abrupt and the area where the change in the color is gradual can be divided, in a case where the strengths of angle characteristics are used as well. Accordingly, an effect can be achieved that is equivalent to a case in which the dividing of the areas is performed based on the frequency components.

Second Embodiment

A second embodiment will be explained with reference to FIGS. 12 to 23. The configurations of the embroidery data creation apparatus 1 and the sewing machine 3 according to the second embodiment and to third to fifth embodiments that will be described later are the same as the configurations according to the first embodiment, so explanations of the configurations will be omitted. The embroidery data creation processing in the embroidery data creation apparatus 1 according to the second embodiment differs from the processing according to the first embodiment that is shown in FIGS. 4 to 6 only in the content of first data creation processing (Step S3 in FIG. 4, FIG. 5). Therefore, hereinafter, for the parts that are the same as the processing according to the first embodiment, the same step numbers will be assigned, and the explanations will be omitted or simplified, while the first data creation processing that is different from the first embodiment will be explained in detail.

In the embroidery data creation processing according to the first embodiment, the first line segments are arranged, and the first line segment colors are set, for each of the color areas independently. In contrast, in the embroidery data creation processing according to the second embodiment, in a case where relationships among a plurality of the color areas that are contiguous satisfy specified conditions, the setting of the thread colors that will be used for the embroidery sewing of the first stitches that correspond to the first line segments is performed collectively for all of the contiguous color areas, with priority given to sewing the first stitches with as few thread colors as possible. The specified conditions are that the representative angles for the contiguous color areas are the same and that for any two of the color areas, one of the color areas is contiguous with the other color area in the normal direction to the representative angle for the other color area. Hereinafter, each one of a plurality of the contiguous color areas that satisfy the specified conditions is called a connectable area.

Figure 12:
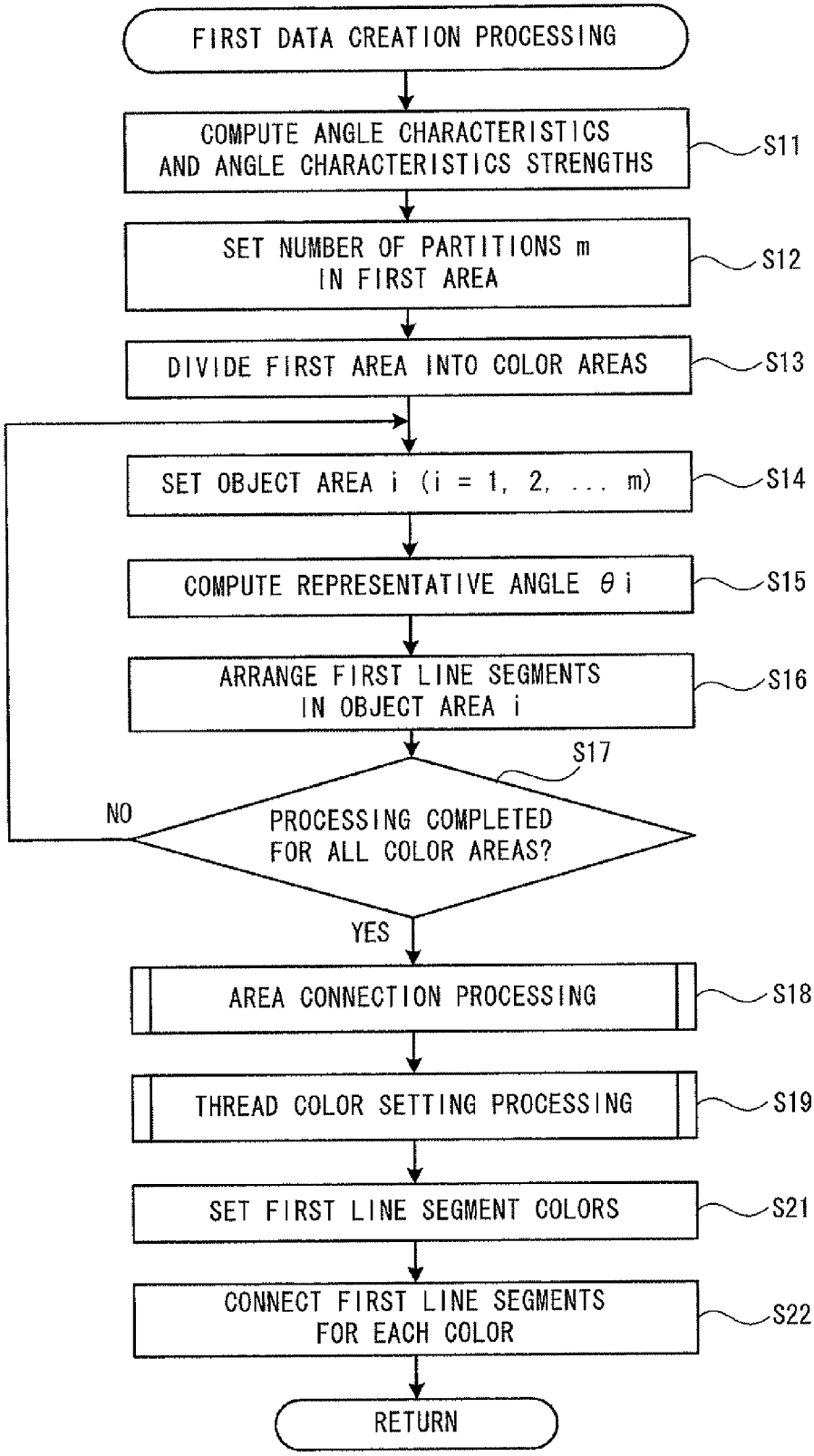
FIG. 12 is a flowchart of the first data creation processing according to a second embodiment.

As shown in FIG. 12, in order to perform the processing that is described above, in the first data creation processing according to the second embodiment, area connection processing (Step S18) and thread color setting processing (Step S19) are performed between the processing that arranges the first line segments (Steps S14 to S17) and the processing that sets the first line segment colors (Step S21). The area connection processing is processing that, in a case where a plurality of the color areas that are contiguous satisfy the specified conditions, sets the contiguous color areas as the connectable areas. The thread color setting processing is processing that, from among the thread colors that the user has prepared to be used by the sewing machine 3 (hereinafter called the prepared thread colors), sets the thread colors that can be used in each of the color areas (hereinafter called the usable thread colors), and then sets the thread colors that will actually be used from among the usable thread colors, such that the number of the colors is as low as possible. The details of the area connection processing (Step S18) and the thread color setting processing (Step S19) will be explained in order with reference to FIGS. 13 to 19.

Figure 13:
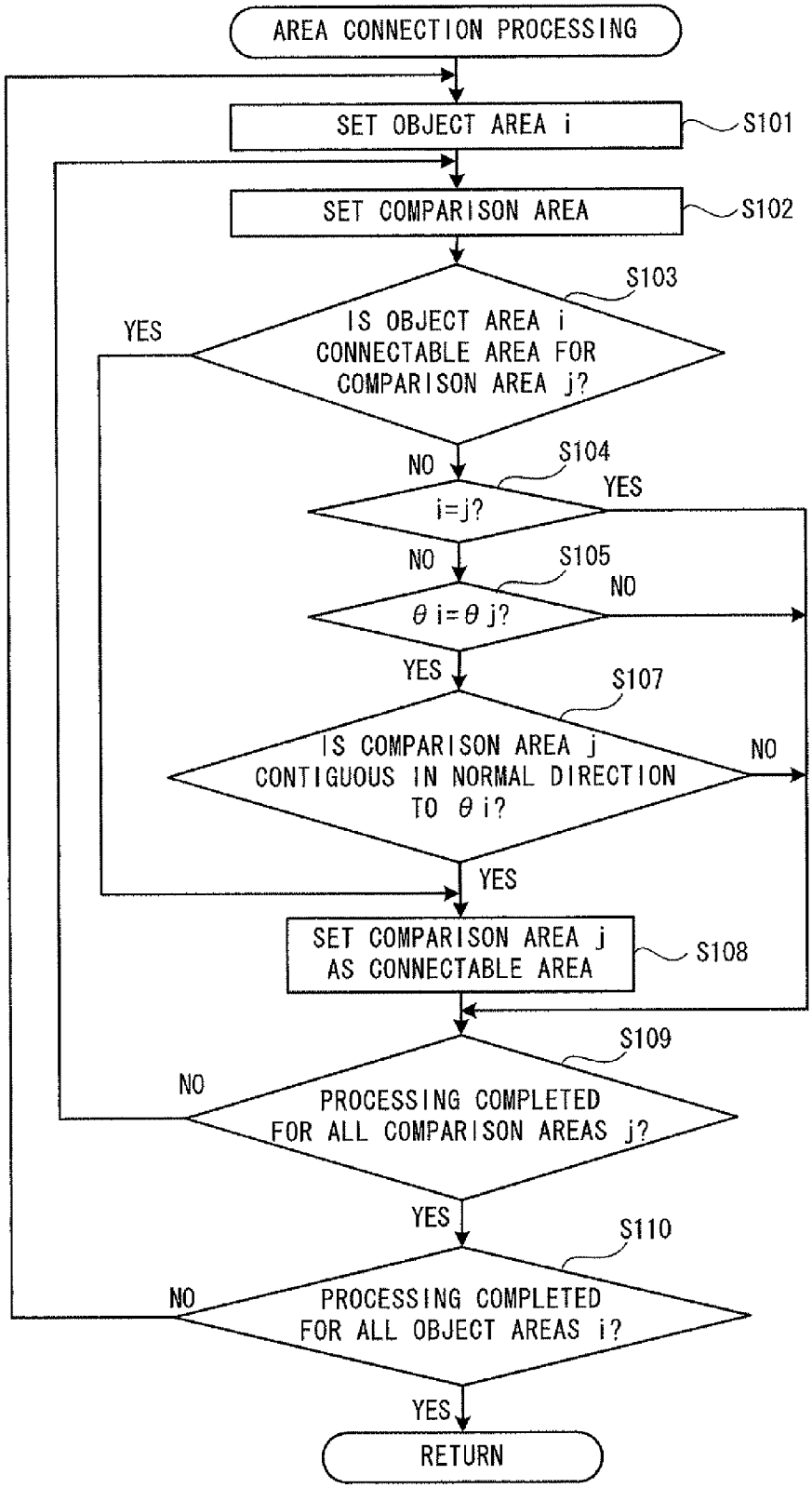
FIG. 13 is a flowchart of area connection processing that is performed in the first data creation processing according to the second embodiment.

As shown in FIG. 13, the object area i is set that is the color area that is the object of the processing (Step S101). i is the variable that is stored in the RAM 12 for sequentially processing the color areas from 1 to m. In the first round of the processing, the variable i is set to an initial value of 1. That is, the color area to which the number 1 has been assigned is set as the object area. Next, a comparison area j is set that is the color area to which the object area i will be compared (Step S102). j is a variable that is stored in the RAM 12 for sequentially processing the color areas from 1 to m. In the first round of the processing, the variable j is set to an initial value of 1. That is, the color area to which the number 1 has been assigned is set as the comparison area.

A matrix is prepared in the RAM 12 for storing results of a comparison between the object areas i and the comparison areas j, the matrix having m rows and m columns, for example, with the rows corresponding to the object areas i and the columns corresponding to the comparison areas j. The initial value for all of the elements in the matrix is zero. The value zero indicates that the comparison area j is not one of the connectable areas for the object area i. If it is determined, as a result of determination processing at Steps S103 to S107 that will be described below, that the comparison area j will be set as one of the connectable areas for the object area i, the value of the element that corresponds to the row i and the column j is updated to 1.

A determination is made as to whether the object area i has already been set as one of the connectable areas for the comparison area j (Step S103). Specifically, the matrix that is described above is referenced, and if the element that corresponds to the row j and the column i is 1, the determination is made that the object area i has already been set as one of the connectable areas for the comparison area j (YES at Step S103). In this case, the connectable area relationship has already been set between the object area i and the comparison area j, so the element of the matrix that corresponds to the row i and the column j is updated to 1, and the comparison area j is set as one of the connectable areas for the object area i (Step S108). On the other hand, if the element that corresponds to the row j and the column i is zero, the determination is made that the object area i has not yet been set as one of the connectable areas for the comparison area j (NO at Step S103). In this case, a determination is made as to whether the variable i and the variable j have the same value (Step S104). If the variable i and the variable j have the same value (YES at Step S104), the object area i and the comparison area j are the same color area, so the comparison cannot be made. Accordingly, the processing advances to Step S109.

In a case where the variable i and the variable j do not have the same value (NO at Step S104) and so the object area i and the comparison area j are different color areas, the representative angles for the color areas that were computed at Step S15 are referenced, and a determination is made as to whether the representative angle θi for the object area i and the representative angle θj for the comparison area j are the same (Step S105). If the two representative angles are not the same (NO at Step S105), the relationship between the object area i and the comparison area j does not satisfy the specified conditions that were described above. Accordingly, the value of the element of the matrix that corresponds to the row i and the column j remains at zero, and the processing advances to Step S109. If the two representative angles are the same (YES at Step S105), a determination is made as to whether the comparison area j is contiguous with the object area i in the normal direction to the representative angle θi for the object area i (Step S107).

The determination at Step S107 may be made by the method hereinafter described. First, one of the pixels in the object area i is defined as an object pixel, and the pixels that are in the normal direction to the representative angle θi (the direction of θi±90 degrees) are traced in order, starting from the object pixel. If the tracing of the pixels leads to one of the pixels that are contained in the comparison area j, the determination is made that the comparison area j is contiguous with the object area i in the normal direction to the representative angle θi (YES at Step S107). In this case, the relationship between the object area i and the comparison area j satisfies the specified conditions that were described above. Accordingly, the comparison area j is set as one of the connectable areas for the object area i by updating to 1 the value of the element of the matrix that corresponds to the row i and the column j (Step S108).

On the other hand, if the tracing of the pixels that are in the normal direction to the representative angle θi, starting from the object pixel, does not lead to one of the pixels that are contained in the comparison area j, the object pixel is changed, and the same processing is repeated. In a case where the tracing does not lead to one of the pixels that are contained in the comparison area j, even if the processing is performed for all of the pixels in the object area i, the determination is made that the comparison area j is not contiguous with the object area i in the normal direction to the representative angle θi (NO at Step S107). In this case, the relationship between the object area i and the comparison area j does not satisfy the specified conditions that were described above, so the value of the element of the matrix that corresponds to the row i and the column j remains at zero, and the processing advances to Step S109.

After the comparison area j has been set as one of the connectable areas for the object area i at Step S108, or after negative determinations have been made at one of Steps S104, S105, and S107, a determination is made as to whether the comparison processing has been completed for all of the comparison areas j in relation to the object area i (Step S109). If the value of the variable j has not become equal to the number (the number of the partitions) m of the color areas, the processing has not been completed for all of the comparison areas j (NO at Step S109). In this case, the processing returns to Step S102. The variable j is incremented by 1, the color area to which the next number has been assigned is set as the next comparison area j, and the same processing that is described above is performed.

In a case where the value of the variable j has become equal to the number of the partitions in, and the comparison processing has been completed for all of the comparison areas j (YES at Step S109), a determination is made as to whether the processing has been completed for all of the object areas i (Step S110). If the value of the variable i has not become equal to the number (the number of the partitions) m of the color areas, the processing has not been completed for all of the object areas i (NO at Step S110). In this case, the processing returns to Step S101. The variable i is incremented by 1, the color area to which the next number has been assigned is set as the next object area i, and the same processing that is described above is performed. In a case where the value of the variable i has become equal to the number of the partitions m, and the comparison processing has been completed for all of the object areas i (YES at Step S110), the area connection processing that is shown in FIG. 13 is terminated, and the processing returns to the first data creation processing that is shown in FIG. 12.

Figure 14:
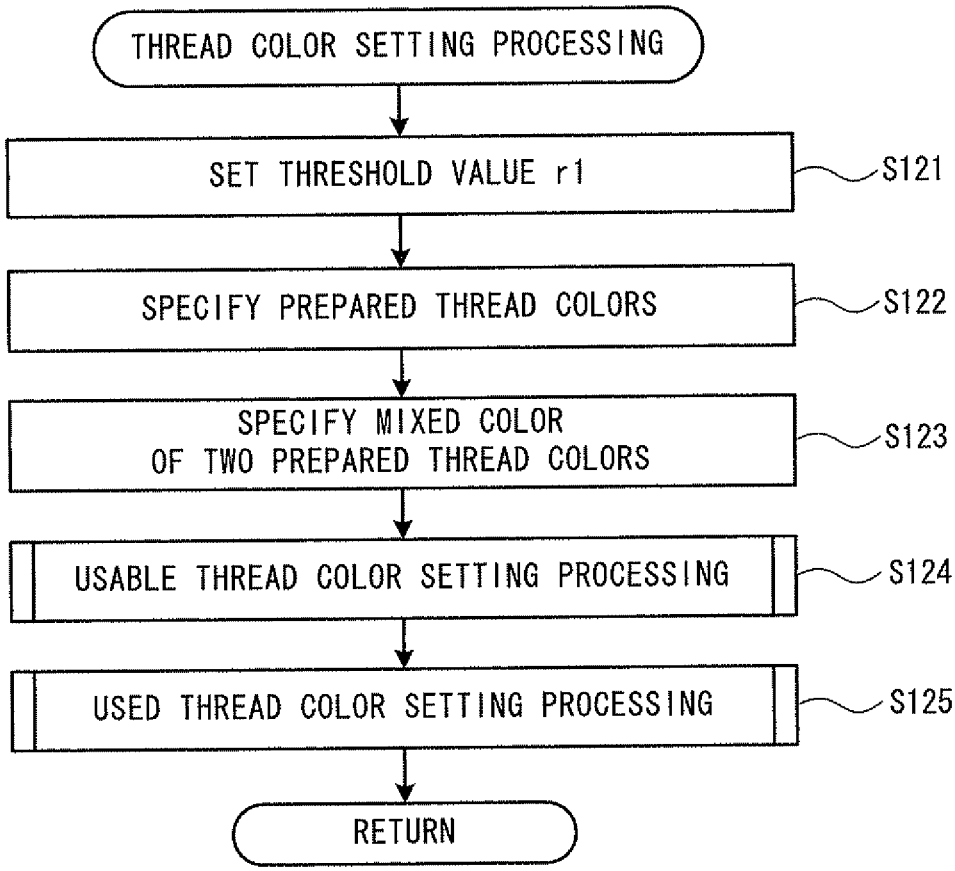
FIG. 14 is a flowchart of thread color setting processing that is performed in the first data creation processing according to the second embodiment.

As shown in FIG. 12, after the area connection processing, the thread color setting processing is performed (Step S19, FIG. 14). As shown in FIG. 14, a threshold value r1 for setting the usable thread colors is set (Step S121). In the present embodiment, the threshold value r1 is set using the distance in the RGB space. For the threshold value r1, a value that has been set in advance and stored in the setting values storage area 154 may be used and a value that the user has input may be used.

Prepared thread colors T, which are the individual thread colors of the n colors of threads that the user has prepared to be used by the sewing machine 3, are specified (Step S122). In the present embodiment, n sets of RGB values from (Rt1, Gt1, Bt1) to (Rtn, Gtn, Btn) are specified as the n colors of the prepared thread colors T1 to Tn. In addition, mixed colors M are specified, each of which is a mixture of two different colors (defined as Tx and Ty) of the n colors of the prepared thread colors T (Step S123). In this case, the number of mixed colors M is ${}_nC_2$ colors in total, that is, n!/(n−2)!2! colors. In the present embodiment, ${}_nC_2$ sets of RGB values from (Rm1, Gm1, Bm1) to ($Rm_nC_2$, $Gm_nC_2$, $Bm_nC_2$) are specified as the mixed colors M1 to $M_nC_2$.

For example, if the set of the RGB values for the mixed color M1, which is a mixture of the prepared colors T1 (Rt1, Gt1, Bt1) and T2 (Rt2, Gt2, Bt2), is defined as (Rm1, Gm1, Bm1), Rm1, Gm1, and Bm1 can be computed as shown below.

$$Rm1=|Rt1+Rt2|\div 2$$

$$Gm1=|Gt1+Gt2|\div 2$$

$$Bm1=|Bt1+Bt2|\div 2$$

All of the RGB values for the mixed colors M1 to $M_nC_2$ can be derived in the same manner.

Figure 15:
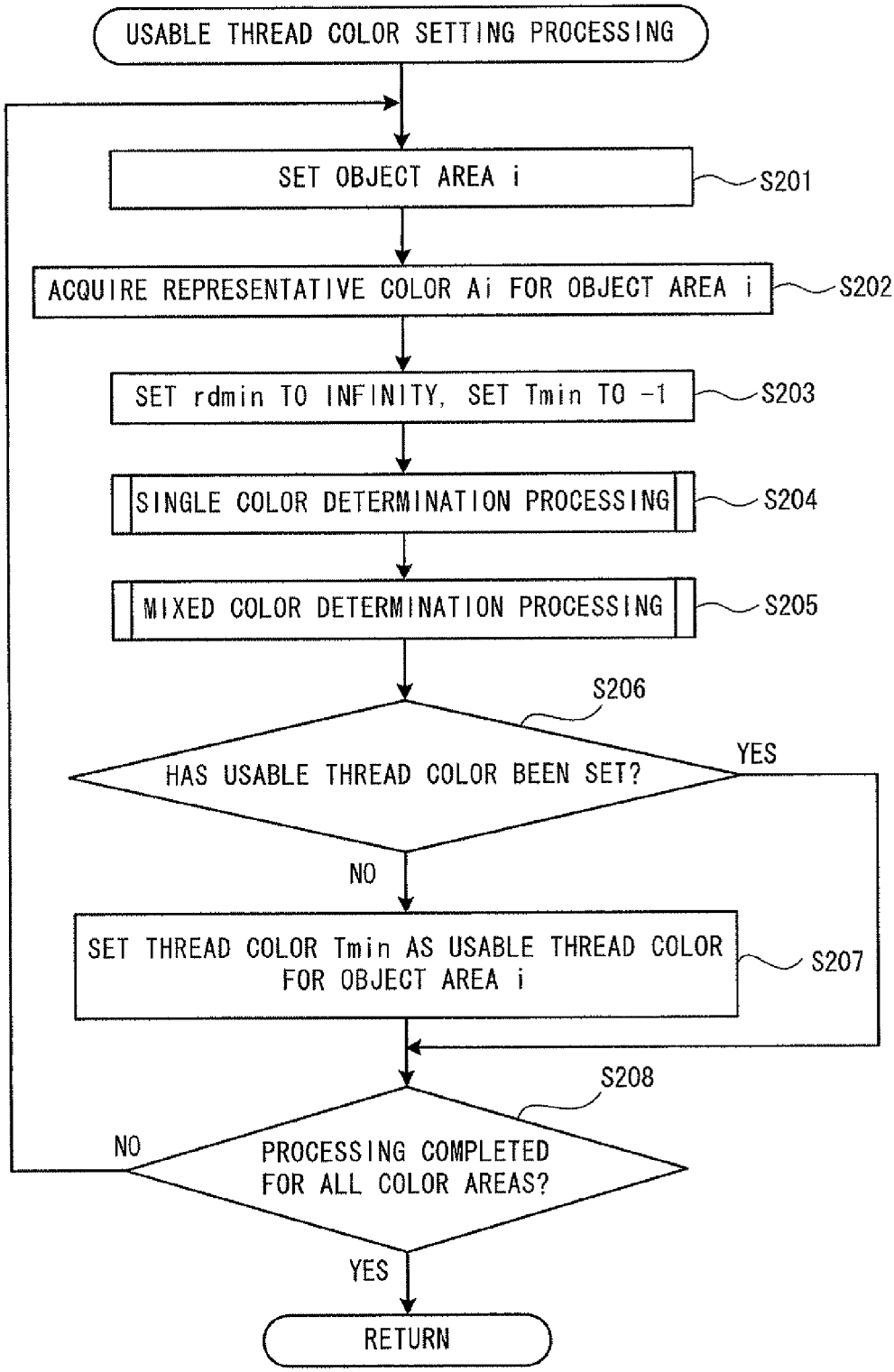
FIG. 15 is a flowchart of usable thread color setting processing that is performed in the thread color setting processing.

Next, usable thread color setting processing is performed that sets the usable thread colors for each of the color areas (Step S124, FIG. 15). As shown in FIG. 15, first, the object area i is set (Step S201). i is the variable that is stored in the RAM 12 for sequentially processing the color areas from 1 to m. In the first round of the processing, the variable i is set to an initial value of 1. A representative color Ai for the object area i is acquired (Step S202). The representative colors, as described previously in the first embodiment, are set by the processing (Step S15 in FIG. 12) that divides the first area into the color areas, and they are stored in the RAM 12. A variable rdmin is set to infinity, and a variable Tmin is set to −1 (Step S203). The variable rdmin is a variable for specifying the minimum value for the distances in the RGB space between the representative color Ai and one of the prepared color T and the mixed color M. The variable Tmin is a variable for specifying a single thread color or a combination of two thread colors for which the distance is the shortest. Next, single color determination processing is performed (Step S204, FIG. 16). The single color determination processing is processing that sets the individual prepared thread color(s) T as the usable thread color(s) in those cases where the distance in the RGB space between the prepared thread color T and the representative color Ai is shorter than the threshold value r1.

Figure 16:
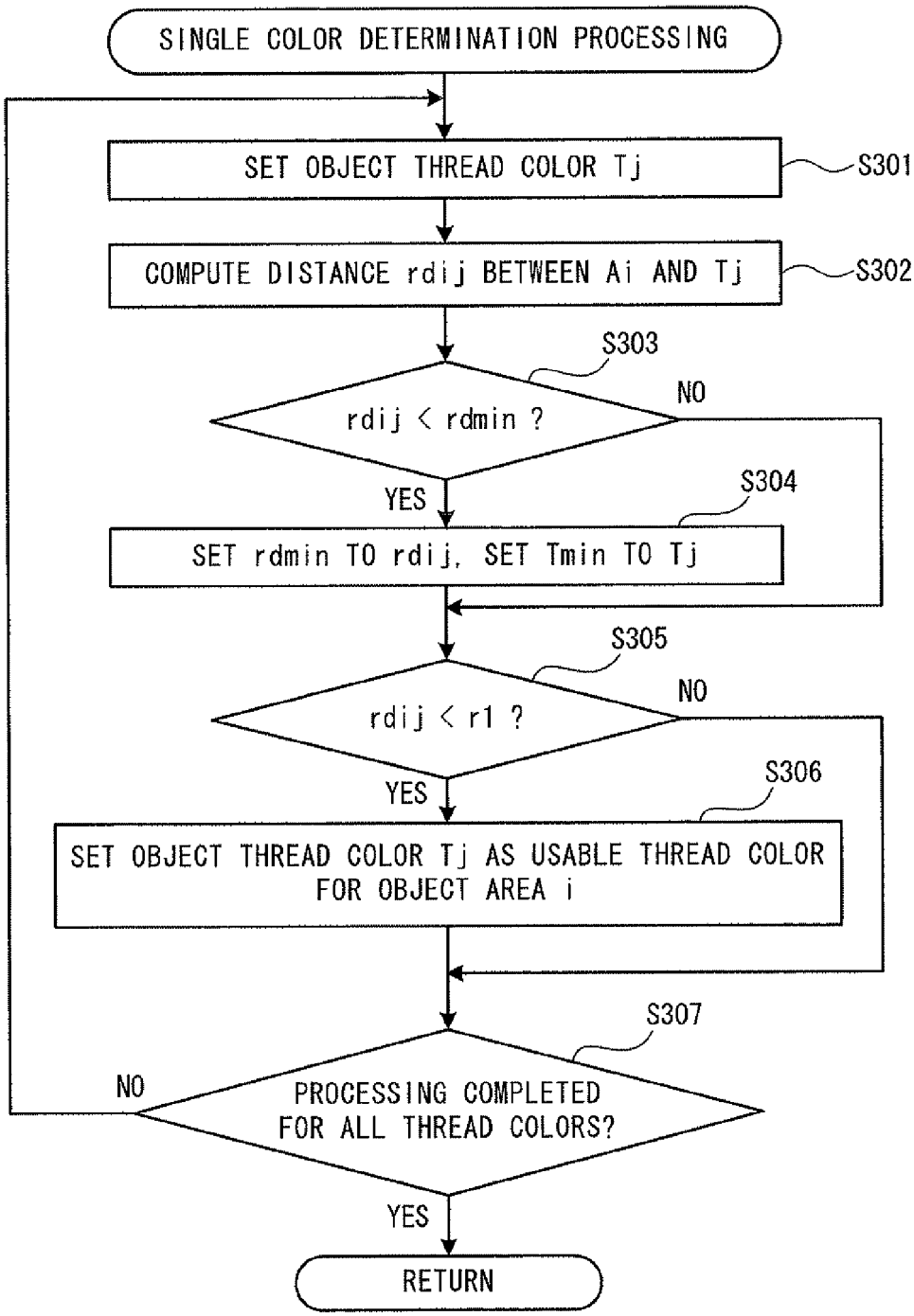
FIG. 16 is a flowchart of single color determination processing that is performed in the usable thread color setting processing.

As shown in FIG. 16, the prepared thread color T that is the object of the processing is set as an object thread color Tj (Step S301). j is a variable that is stored in the RAM 12 for sequentially processing the prepared thread colors T from 1 to n. In the first round of the processing, the variable j is set to an initial value of 1. That is, the prepared thread color T1, to which the number 1 has been assigned, is set as the object thread color. A distance rdij in the RGB space between the object thread color Tj and the representative color Ai for the object area i is computed (Step S302). Specifically, in a case where the set of the RGB values for the object thread color Tj is defined as (Rtj, Gtj, Btj) and the set of the RGB values for the representative color Ai is defined as (Rai, Gai, Bai), the distance rdij is derived by the formula below.

$$rdij=\sqrt{\{(Rtj-Rai)^2+(Gtj-Gai)^2+(Btj-Bai)^2\}}$$

A determination is made as to whether the computed distance rdij is less than the variable rdmin (Step S303). If the distance rdij is less than the variable rdmin (YES at Step S303), the variable rdmin is updated to the distance rdij. The variable Train is updated to the object thread color Tj, that is, to the prepared thread color Tj (Step S304). The processing advances to Step S305. If the distance rdij is not less than the variable rdmin (NO at Step S303), the processing advances to Step S305. A determination is made as to whether the distance rdij is less than the threshold value r1 (Step S305). In a case where the distance rdij is less than the threshold value r1 (YES at Step S305), the distance rdij is within a range in which the object thread color Tj (the prepared thread color Tj) and the representative color Ai have a certain degree of similarity, so the object thread color Tj (the prepared thread color Tj) is set as one of the usable thread colors for the object area i. The object thread color Tj is stored in the RAM 12 in association with the object area i (Step S306). The processing advances to Step S307.

In a case where the distance rdij is not less than the threshold value r1 (NO at Step S305), the object thread color Tj and the representative color Ai are not particularly similar colors. Accordingly, the processing advances to Step S307 without the object thread color Tj being set as one of the usable thread colors. A determination is made as to whether the processing has been completed for all of the prepared thread colors T (Step S307). If the value of the variable j has not become equal to the number n of the prepared thread colors T, the processing has not been completed (NO at Step S307). In this case, the processing returns to Step S301. The variable j is incremented by 1, the prepared thread color T to which the next number has been assigned is set as the next object thread color Tj, and the same processing that is described above is performed. If the value of the variable j has become equal to n, the processing has been completed for all of the prepared thread colors T (YES at Step S307), so the single color determination processing that is shown in FIG. 16 is terminated, and the processing returns to the usable thread color setting processing in FIG. 15.

Figure 17:
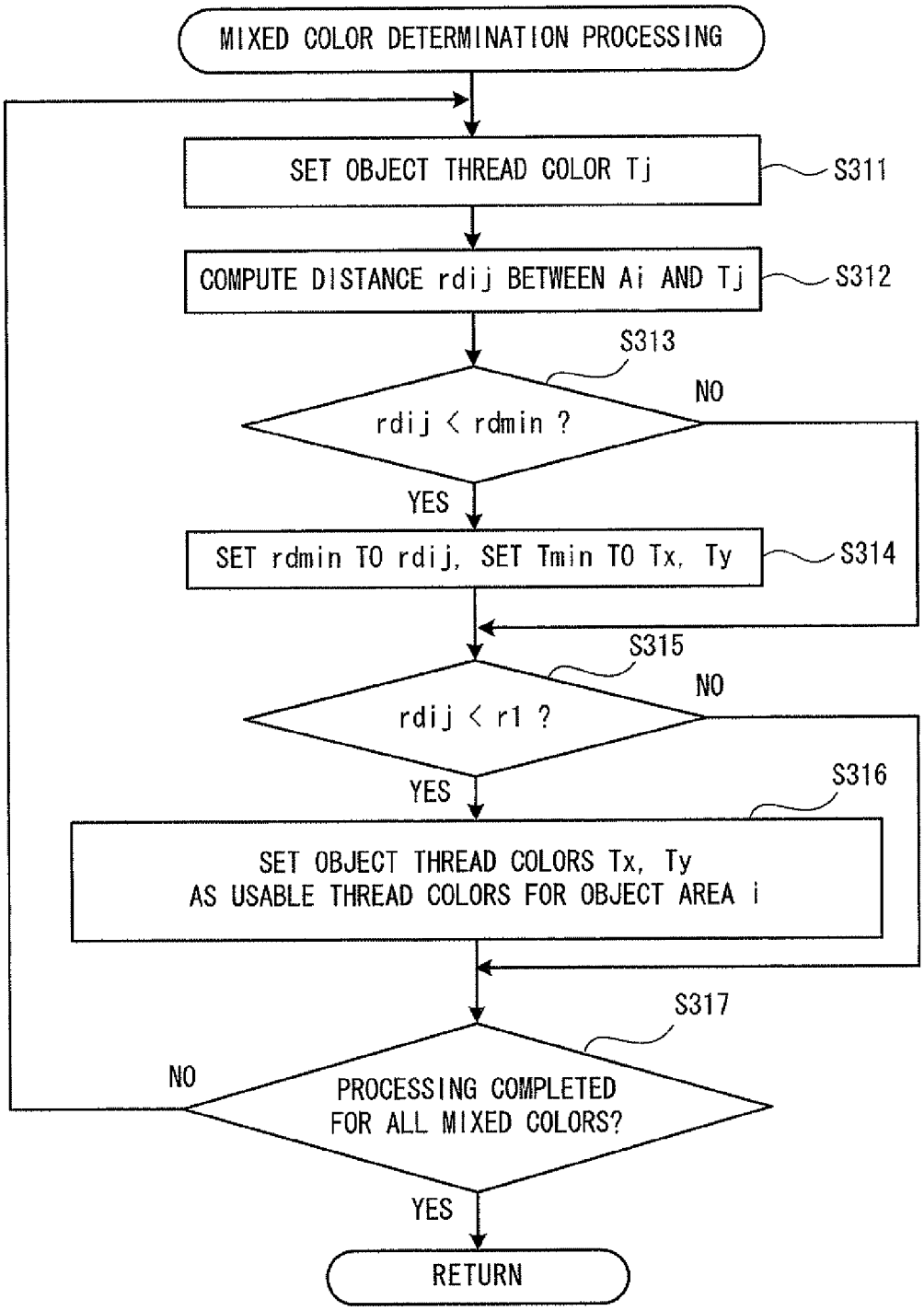
FIG. 17 is a flowchart of mixed color determination processing that is performed in the usable thread color setting processing.

As shown in FIG. 15, following the single color determination processing (Step S204), mixed color determination processing is performed (Step S205, FIG. 17). The mixed color determination processing is processing that sets the individual mixed thread colors M of the prepared thread colors Tx and Ty as the usable thread colors in those cases where the distance in the RGB space between the mixed thread color M and the representative color Ai is shorter than the threshold value r1. As shown in FIG. 17, the mixed color M that is the object of the processing is set as the object thread color Tj (Step S311). j is a variable that is stored in the RAM 12 for sequentially processing the mixed colors M from 1 to ${}_nC_2$. In the first round of the processing, the variable j is set to an initial value of 1. That is, the mixed color M1, to which the number 1 has been assigned, is set as the object thread color Tj (the mixed color Mj). The distance rdij in the RGB space between the mixed color Mj and the representative color Ai for the object area i is computed (Step S312). The computation method is the same as the method that was used at Step S302 of the single color determination processing.

A determination is made as to whether the computed distance rdij is less than the variable rdmin (Step S313). If the distance rdij is less than the variable rdmin (YES at Step S313), the variable rdmin is updated to the distance rdij. The variable Tmin is updated to the object thread color Tj, that is, to the two prepared thread colors Tx and Ty for expressing the mixed color Mj (Step S314). The processing advances to Step S315. If the distance rdij is not less than the variable rdmin (NO at Step S313), the processing advances to Step S315. A determination is made as to whether the distance rdij is less than the threshold value r1 (Step S315). In a case where the distance rdij is less than the threshold value r1 (YES at Step S315), the distance rdij is within a range in which the object thread color Tj (the mixed color Mj) and the representative color Ai have a certain degree of similarity, so the two prepared thread colors Tx and Ty for expressing the object thread color Tj (the mixed color Mj) are set as two of the usable thread colors for the object area i. The two prepared thread colors Tx and Ty are stored in the RAM 12 in association with the object area i (Step S316). The processing advances to Step S317.

In a case where the distance rdij is not less than the threshold value r1 (NO at Step S315), the object thread color Tj and the representative color Ai are not particularly similar colors. Accordingly, the processing advances to Step S317 without the object thread color Tj being set as the usable thread color. A determination is made as to whether the processing has been completed for all of the mixed colors M (Step S317). If the value of the variable j has not become equal to the number ${}_nC_2$ of the mixed colors M, the processing has not been completed (NO at Step S317), and the processing returns to Step S311. The variable j is incremented by 1, the mixed color M to which the next number has been assigned is set as the next object thread color Tj, and the same processing that is described above is performed. If the value of the variable j has become equal to ${}_nC_2$, the processing has been completed for all of the mixed colors M (YES at Step S317), so the mixed color determination processing that is shown in FIG. 17 is terminated, and the processing returns to the usable thread color setting processing in FIG. 15.

As shown in FIG. 15, in the usable thread color setting processing, next, a determination is made as to whether any of the usable thread colors have been set by the single color determination processing and the mixed color determination processing (Step S206). The usable thread color that has been set by the single color determination processing is a single color that by itself can express a color that has a certain degree of similarity to the representative color Ai for the object area i. The usable thread colors that have been set by the mixed color determination processing are a set of two colors that by being mixed can express a color that has a certain degree of similarity to the representative color Ai for the object area i. If at least one usable thread color has been set (YES at Step S206), the processing advances to Step S208.

If there are no usable thread colors that have been set (NO at Step S206), there would be no thread colors that can be used in the object area i, which is disadvantageous. Accordingly, the thread color that has been stored as the variable Tmin is set as the usable thread color and is stored in the RAM 12 (Step S207). The thread color Tmin is one of the single prepared thread color Tj and the combination of the two prepared thread colors Tx and Ty that corresponds to the one of the prepared thread color T and the mixed color M for which the distance rdij is the shortest that is not less than the threshold value r1. A determination is made as to whether the setting of the usable thread colors has been completed for all of the color areas (Step S208). If the variable i has not become equal to the number m of the color areas, indicating that at least one unprocessed color area exists (NO at Step S208), the processing returns to Step S201. The variable i is incremented by 1, the color area to which the next number has been assigned is set as the next object area i, and the same processing that is described above is performed. If the variable i has become equal to the number m and the processing has been completed for all of the color areas (YES at Step S208), the usable thread color setting processing is terminated, and the processing returns to the thread color setting processing that is shown in FIG. 14.

Figure 18:
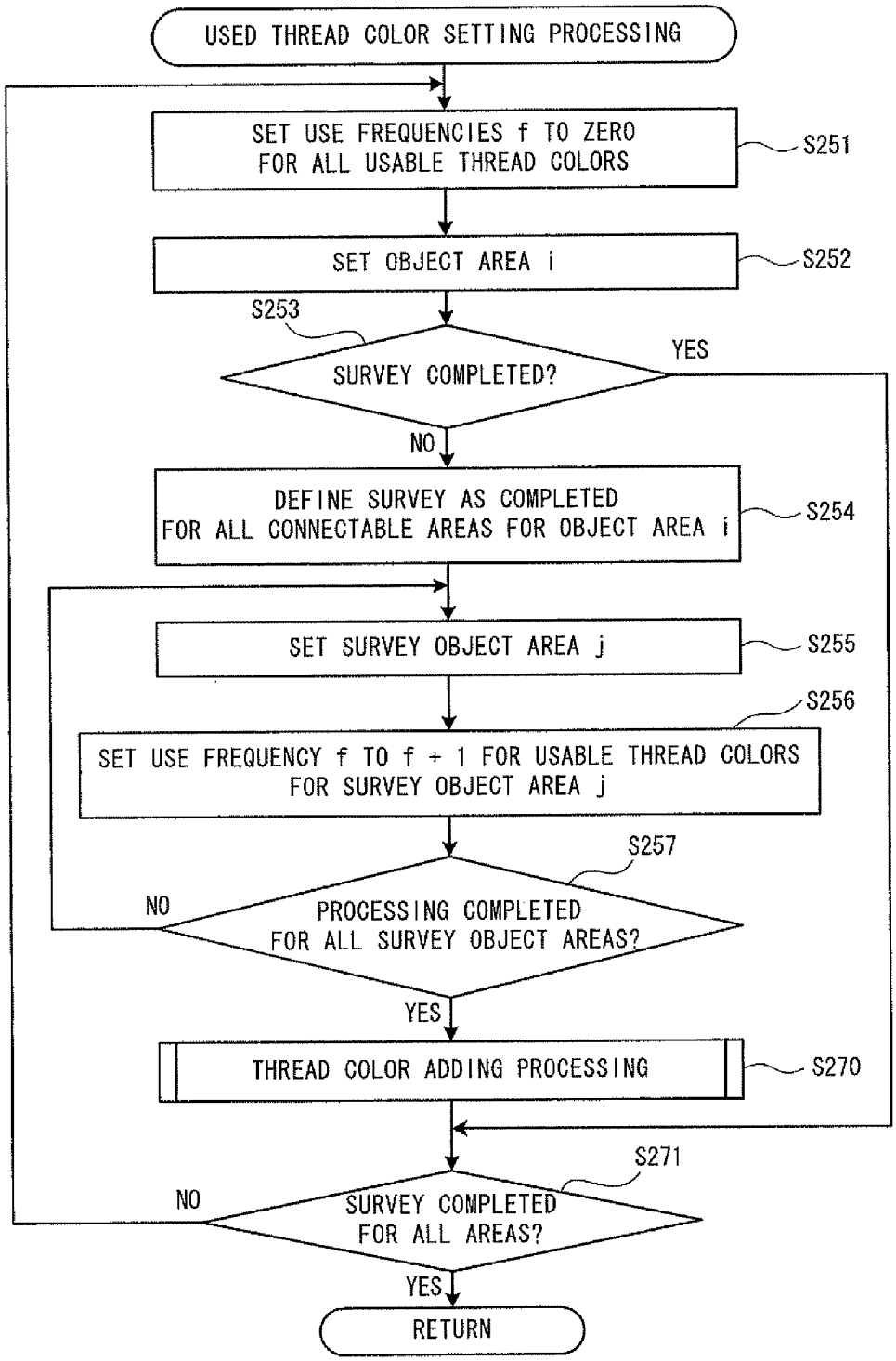
FIG. 18 is a flowchart of used thread color setting processing that is performed in the thread color setting processing.
Figure 19:
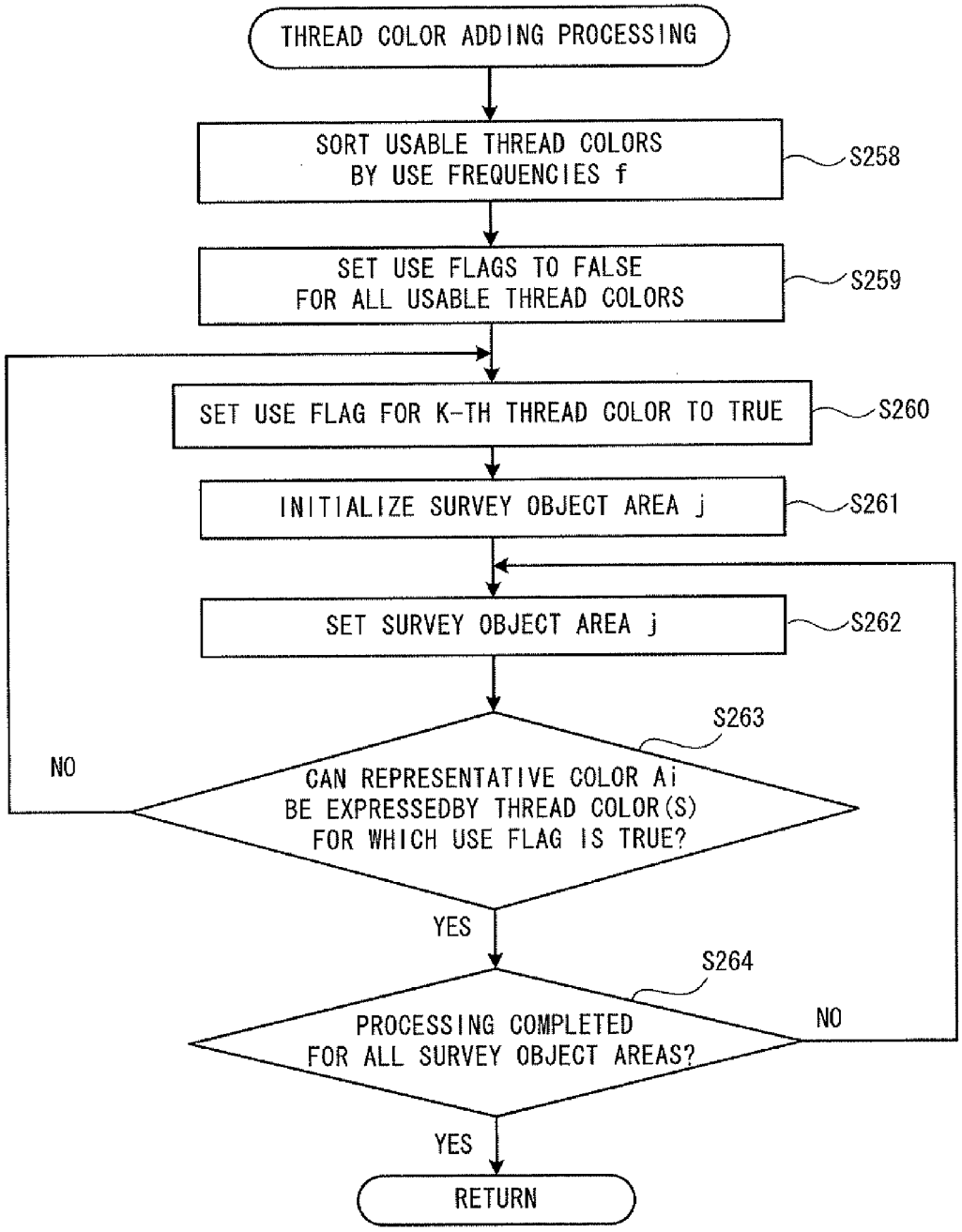
FIG. 19 is a flowchart of thread color adding processing that is performed in the thread color setting processing, continued from FIG. 18.

As shown in FIG. 14, following the usable thread color setting processing (Step S124), used thread color setting processing is performed (Step S125, FIGS. 18 to 19). The used thread color setting processing is processing that, based on use frequencies, sets used thread colors, which are the thread colors, among the usable thread colors that have been set, that will be used for the actual embroidery sewing. As shown in FIG. 18, use frequencies f for all of the usable thread colors that have been set by the usable thread color setting processing (refer to FIG. 15) are set to zero and are stored in the RAM 12 (Step S251). In addition, for each of the color areas, a survey flag that indicates whether or not the use frequency and the used thread color for the color area have been surveyed is set to FALSE, a value that indicates "not yet surveyed", and the survey flag is stored in the RAM 12. Next, the object area i is set (Step S252). i is the variable that is stored in the RAM 12 for sequentially processing the color areas from 1 to m. In the first round of the processing, the variable i is set to an initial value of 1.

A determination is made as to whether the survey of the use frequencies has already been completed for the object area i (Step S253). If the survey flag that corresponds to the object area i is FALSE, the determination is made that the survey has not been completed for the object area i (NO at Step S253). The matrix that was created by the area connection processing (refer to FIG. 13) and stored in the RAM 12 is referenced, and if another of the color areas has been set as one of the connectable areas for the object area i, the object area i and all of the connectable areas for the object area i are specified as a connectable area group. In this case, the connectable area group is specified as a single survey object group, to which a number is assigned, and the survey flag for each of the color areas within the group is updated to TRUE, indicating that the survey has been completed (Step S254). In a case where a separate one of the color areas (for example, the color area 2) has been set as one of the connectable areas for the object area i (for example, the color area 1), and still another of the color areas (for example, the color area 3) has been set as one of the connectable areas for that connectable color area, the three color areas are defined as the connectable area group and become a single survey object group.

Each of the color areas within the survey object group is successively set as a survey object area j, and processing is performed that determines the use frequencies (Steps S255 to S257). First, one of the color areas within the survey object group is set as the survey object area j (Step S255). j is a variable that is stored in the RAM 12 for sequentially processing the color areas within the survey object group. In the first round of the processing, the variable j is set to an initial value of 1. The variable j is used to count from 1 to the number of the color areas within the survey object group. The use frequency for each of the usable thread color(s) that have been set as corresponding to the survey object area j is incremented by 1 (Step S256). Next, a determination is made as to whether the processing has been completed for all of the color areas within the survey object group (Step S257). If the variable j is not equal to the number of the color areas within the survey object group, indicating that at least one unprocessed color area exists (NO at Step S257), the processing returns to Step S255. The variable j is incremented by 1, the next color area is set as the survey object area j, and the same processing that is described above is performed.

If the processing has been completed for all of the color areas within the survey object group (YES at Step S257), thread color adding processing is performed (S270, FIG. 19). As shown in FIG. 19, in the thread color adding processing, first, all of the usable thread colors are sorted by their use frequencies f (Step S258). For every one of the usable thread colors, a use flag that indicates whether or not the usable thread color is set as a used thread color that will actually be used is set to an initial value of FALSE, indicating that the usable thread color will not be used (Step S259). The k-th usable thread color in the sort order is selected from among the usable thread colors, and the use flag for the k-th usable thread color is updated to TRUE, indicating that the k-th usable thread color will be used (Step S260). In other words the k-th usable thread color is set as a used thread color. k is a variable that is stored in the RAM 12 for sequentially processing the usable thread colors. In the first round of the processing, the variable k is set to an initial value of 1. The variable k is used to count from 1 to the number of the usable thread colors.

The survey object area j is initialized by setting the variable j to the initial value of 1 (Step S261). Once again, the first of the color areas within the survey object group is set as the survey object area j (Step S262). A determination is made as to whether the representative color Ai for the survey object area j can be expressed by the used thread color for which the use flag has been set to TRUE (Step S263). At the time that the first round of the processing is performed, there is one color that has been set as the used thread color. In the usable thread color setting processing (refer to FIG. 15) that was described above, either one color or two colors are set for the object area i and stored in the RAM 12. Accordingly, if one color has been set as the usable thread color for the object area i, and if that one color matches the used thread color, the determination is made that the representative color Ai can be expressed by the used thread color (YES at Step S263). A determination is made as to whether the processing has been completed for all of the color areas in the survey object group (Step S264). If an unprocessed color area exists (NO at Step S264), the processing returns to Step S262. The variable j is incremented by 1, the color area to which the next number has been assigned is set as the next survey object area j, and the processing thereafter is performed in the same way.

In contrast, in a case where the used thread color is one color, and that color has not been stored in the RAM 12 as the usable thread color for the object area i, the representative color Ai cannot be expressed by the one used thread color (NO at Step S263). In that case, the processing returns to Step S260. The variable k is incremented by 1, and the next usable thread color in the sort order is selected and is set as the used thread color. In other words, in a case where the representative color Ai of the survey object area j cannot be expressed solely by the color that has already been set as the used thread color, the number of the used thread colors is increased by selecting the usable thread colors in order starting with the usable thread color that has the highest use frequency. Then a determination is made as to whether the representative color Ai for the survey object area j can be expressed by one color or two colors among the plurality of the used thread colors that have been set (Step S263). In a case where one color that has been set for the object area i matches one of the used thread colors, as well as in a case where two colors that have been set as the usable thread colors for the object area i match two of the used thread colors, the determination is made that the representative color Ai can be expressed by the used thread colors (YES at Step S263).

In this manner, the usable thread color may be added as the used thread color in order by their use frequencies, and when enough of the used thread colors have been set that the representative colors Ai for all of the survey object areas can be expressed (YES at Step S264), the thread color adding processing that is shown in FIG. 19 is terminated, and the processing returns to the used thread color setting processing that is shown in FIG. 18. As shown in FIG. 18, following the thread color adding processing (S270), a determination is made as to whether the survey has been completed (Step S271). Specifically, the survey flags that are stored in the RAM 12 are referenced, and a determination is made as to whether the survey flags for all of the color areas have been set to TRUE. In a case where an unsurveyed color area exists (NO at Step S265), the processing returns to Step S251, and the use frequencies f for all of the usable thread colors are once again initialized to zero. Then the variable i is incremented by 1, and the color area with the next number is set as the object area i (Step S252). As described previously, the survey flags have been set to TRUE and the survey has been completed for the color areas that have already been set as the object areas i and for their connectable areas. Accordingly, in a case where the survey flag is TRUE for the color area with the next number (YES at Step S253), the processing advances immediately to Step S271. If the object area i is an unsurveyed color area (NO at Step S253), the same processing that was described above is performed.

If the result of the processing is that the survey flags for all of the color areas have been set to TRUE, indicating that the survey has been completed (YES at Step S271), the used thread color setting processing is terminated, and the processing returns to the thread color setting processing in FIG. 14. As shown in FIG. 14, after the used thread color setting processing (Step S125), the thread color setting processing is terminated, and the processing returns to the first data creation processing that is shown in FIG. 12. Next, as shown in FIG. 12, first line segment color setting processing is performed (Step S21). In the first embodiment, the color that is the closest to the representative color for the color area is set as the first line segment color for all of the first line segments that have been arranged in that color area. In the second embodiment, for each of the first line segments, from among the plurality of the used thread colors that have been set based on the representative color Ai for the color area, as described previously, the one color that most closely approximates the color of the original image is selected, and the selected color is set as the first line segment color.

The first line segment colors may be set using the same method as the method for setting the second line segment colors in the second data creation processing (refer to FIG. 6) in the first embodiment, for example. That is, the first line segment colors may be set as hereinafter described, in accordance with the method that is described in detail in Japanese Laid-Open Patent Publication No. 2001-259268, the relevant portions of which are incorporated herein by reference. One of the plurality of the pixels that make up the first area is designated as the object pixel. The color of the first line segment that corresponds to the object pixel is set such that the average value of the colors that have already been set for the line segments that have been arranged in an area that is the same size as the reference area and that has the object pixel at its center is equal to the average value of the colors within the reference area in the original image. In other words, the colors of the individual first line segments are set based on the colors of the original image and on the colors of the line segments that have already been set. This processing is performed in order for all of the plurality of the pixels that make up the first area. After the first line segment colors have been set, the first line segments for each of the first line segment colors are connected by the same method as in the first embodiment (Step S22), and the first data creation processing is terminated.

Figure 21:
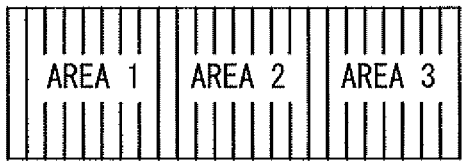
FIG. 21 is an explanatory figure that shows examples of first line segments that have been arranged in the areas 1 to 3 in FIG. 20.

A specific example of the first data creation processing (FIGS. 12 to 19) in the second embodiment that has been explained above will be explained with reference to FIGS. 20 to 23. In the specific example, it is assumed that at Steps S12 to S13 in the first data creation processing that is shown in FIG. 12, a first area R1 is divided into the color areas 1 to 3 (hereinafter simply called the areas 1 to 3), as shown in FIG. 20, based on the number of partitions m being equal to 3. The representative colors (the sets of the RGB values) for the areas 1 to 3 are red (255, 0, 0), purple (128, 0, 128), and blue (0, 0, 255), respectively. Further, it is assumed that at Steps S14 to S17, the representative angles for the areas 1 to 3 are computed as 90 degrees, 90 degrees, and 90 degrees, respectively. Then, as shown in FIG. 21, in each of the areas 1 to 3, the first line segments, which extend parallel to one another in the 90-degree direction and have endpoints ends on the boundary lines of their respective areas, are arranged at equal intervals. Sequential numbers are assigned to the first line segments that have been arranged, starting from the left side of FIG. 21.

The processing thereafter in the first data creation processing (Steps S18 to S22 in FIG. 12) is specifically as described below. In the area connection processing (Step S18 and FIG. 13), in a case where the area 1 is the object area, the area 1 has the same 90-degree representative angle as the area 2 (YES at Step S105 in FIG. 13) and is contiguous with the area 2 in the normal direction, that is, in the zero-degree direction (YES at Step S107). Accordingly, the area 2 is set as a connectable area for the area 1 (Step S108). The area 1 also has the same 90-degree representative angle as the area 3 (YES at Step S105), but it is not contiguous with the area 3 (NO at Step S107), so the area 3 is not set as a connectable area for the area 1.

In a case where the area 2 is the object area, the area 2 has already been set as a connectable area for the area 1 (YES at Step S103), so the area 1 is set as a connectable area for the area 2 (Step S108). The area 2 has the same 90-degree representative angle as the area 3 (YES at Step S105) and is contiguous with the area 3 in the normal direction, that is, in the zero-degree direction (YES at Step S107). Accordingly, the area 3 is set as a connectable area for the area 2 (Step S108). In a case where the area 3 is the object area, the area 3 is not contiguous with the area 1 (NO at Step S107), so the area 1 is not set as a connectable area for the area 3. The area 3 has already been set as a connectable area for the area 2 (YES at Step S103), so the area 2 is set as a connectable area for the area 3 (Step S108), and the area connection processing is terminated.

It is assumed that the prepared thread colors that the user has prepared to be used by the sewing machine 3 are the four colors red (255, 0, 0), purple (128, 0, 128), blue (0, 0, 255), and yellow (255, 255, 0). In the thread color setting processing (Step S19), as shown in FIG. 14, after 16, for example, has been set as the threshold value r1 (Step S121), the respective sets of the RGB values for the four prepared thread colors are specified, as are the respective sets of the RGB values for the ${}_4C_2$ mixed colors, that is, the six mixed colors, that are mixtures of two different ones of the four prepared thread colors (Steps S122, S123).

Next, in the usable thread color setting processing (Step S124 in FIG. 14), in a case where the area 1 is the object area, the distance between the representative color red (255, 0, 0) for the area 1 and the prepared thread color red (255, 0, 0) is zero, so in the single color determination processing (Step S204 in FIG. 15, FIG. 16), red is set as the usable thread color. The distances between the other prepared thread colors and the representative color red for the area 1 are not less than the threshold value r1, so the other prepared thread colors are not set as the usable thread colors. In the mixed color determination processing (Step S205 in FIG. 15, FIG. 17), the distances between the six mixed colors and the representative color red for the area 1 are all not less than the threshold value r1, so the six mixed colors are not set as the usable thread colors. Accordingly, the one color red is set as the usable thread color for the area 1.

In a case where the area 2 is the object area, the distance between the representative color purple (128, 0, 128) for the area 2 and the prepared thread color purple (128, 0, 128) is zero, so in the single color determination processing, purple is set as the usable thread color. The distances between the other prepared thread colors and the representative color purple for the area 2 are not less than the threshold value r1, so the other prepared thread colors are not set as the usable thread colors. In the mixed color determination processing, of the six mixed colors, the distance between the representative color purple for the area 2 and the mixed color of red (255, 0, 0) and blue (0, 0, 255) is less than the threshold value r1 Accordingly, the prepared thread colors red and blue are set as the usable thread colors. The distances between the other five mixed colors and the representative color purple for the area 2 are all not less than the threshold value r1, so the other five mixed colors are not set as the usable thread colors. Accordingly, three colors, the single color purple and the colors red and blue that are the bases for the mixed color, are set as the usable thread colors for the area 2.

In a case where the area 3 is the object area, the distance between the representative color blue (0, 0, 255) for the area 3 and the prepared thread color blue (0, 0, 255) is zero, so in the single color determination processing, blue is set as the usable thread color. The distances between the other prepared thread colors and the representative color blue for the area 3 are not less than the threshold value r1, so the other prepared thread colors are not set as the usable thread colors. In the mixed color determination processing, the distances between the six mixed colors and the representative color blue for the area 3 are all not less than the threshold value r1, so the six mixed colors are not set as the usable thread colors. Accordingly, the one color blue is set as the usable thread color for the area 3.

Next, in the used thread color setting processing (Step S125 in FIG. 14), the used thread colors are set based on the use frequencies of all of the usable thread colors that have been set for the areas 1 to 3, that is, the three colors red, purple, and blue. When the area 1 is set as the object area, the area 2 has been set as the connectable area for the area 1, and the area 3 has been set as the connectable area for the area 2, so the areas 1 to 3 are specified as a connectable area group, which becomes the survey object group (Step S254 in FIG. 18). The areas 1 to 3 are successively specified as the survey object area, and when the use frequencies for the usable thread colors are computed, 2 is obtained as the use frequency for red, 1 as the use frequency for purple, and 2 as the use frequency for blue (Steps S255 to S257). When the three usable thread colors are sorted by their use frequencies, the resulting order is red (2), blue (2), and purple (1) (Step S258 in FIG. 19).

First, red, which is the first usable thread color in the sort order, is specified as the used thread color. Because red has been set as the usable thread color for the area 1, it can express the red that is the representative color for the area 1. Red has also been set, in combination with blue, as one of the usable thread colors for the area 2, but red alone cannot express the purple that is the representative color for the area 2. Accordingly, blue, which is the second usable thread color in the sort order, is also specified as one of the used thread colors. In other words, there are two used thread colors, red and blue. That means that the purple that is the representative color for the area 2 can be expressed by the mixed color of those two colors. The blue that is the representative color for the area 3 can also be expressed by the used thread color blue alone (Steps S260 to S264). Therefore, among the three usable thread colors red, purple, and blue, the two colors red and blue are set as the used thread colors for the areas 1 to 3 with the three colors red, purple, and blue, and the thread color setting processing is terminated.

Figure 22:
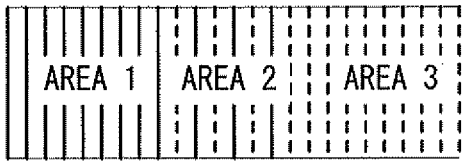
FIG. 22 is an explanatory figure that shows examples of first line segment colors that have been set for the first line segments in FIG. 21.

Then, as described previously, the colors of the original image and the first line segment colors that have already been set are referenced, and one of the red and the blue that are the used thread colors is set as the first line segment color for each of the first line segments (Step S21 in FIG. 12). The color of the original image that corresponds to the area 1 is close to red, so for the first line segments that have been arranged in the area 1, as shown in FIG. 22, the first line segment color for the first of the first line segments (the line segment that is the farthest to the left) is set to red (shown by a solid line in FIG. 22). The first line segment colors for the remaining first line segments that have been arranged in the area 1 are set by referencing the color that is close to red in the original image and the red that has already been set as the first line segment color, so red is also set for those first line segment colors. The color of the original image that corresponds to the area 2 is close to purple, so the colors of the original image and the first line segment colors that have already been set are referenced, and as shown in FIG. 22, for example, red and blue (shown by broken lines in FIG. 22) are alternately set as the first line segment colors. The color of the original image that corresponds to the area 3 is close to blue, so the colors of the original image and the first line segment colors that have already been set are referenced, and blue is set as the first line segment color for the first line segments that have been arranged in the area 3.

Figure 23:
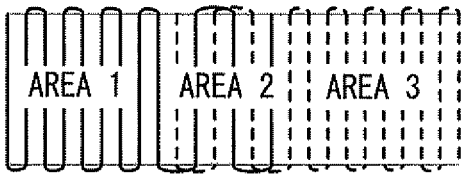
FIG. 23 is an explanatory figure that shows examples in which the first line segments of each first line segment color in FIG. 22 have been connected.

When the first line segments for each of the first line segment colors that have been set in this manner are connected (Step S22 in FIG. 12), the red first line segments are connected from the area 1 into the area 2, as shown in FIG. 23, starting with the earliest of the sequential numbers that were assigned when the first line segments were arranged. The blue first line segments are connected from the area 2 into the area 3, starting with the earliest of the sequential numbers that were assigned when the blue first line segments were arranged. In other words, within the plurality of the color areas that have been specified as the connectable area group, as have the area 1 and the area 2, and the area 2 and the area 3, it is possible to control the sequential connecting of the first line segments.

As explained above, according to the first data creation processing according to the second embodiment, in a case where a plurality of the color areas that have the same representative angle are contiguous with one another in the normal direction to the representative angle, the plurality of the color areas are treated collectively as a connectable area group. Then, based on the frequencies with which the individual usable thread colors, which have been set in accordance with the representative colors of the color areas in the area group, can be used within the area group, the smallest number of the usable thread colors that can express the colors of the entire area group are set as the used thread colors that will actually be used.

Therefore, in a case where an entire area group that includes three color areas can be expressed by two usable thread colors by using a mixed color to express one of the three color areas within the connectable area group, as in the specific example that was described above, for example, the thread colors that will actually be used are two colors. The connectable area group can thus be sewn with the minimum number of thread colors, so the embroidery pattern that corresponds to the original image can be expressed by the lowest possible number of threads. Moreover, because the representative angles of the color areas that are included in the connectable area group are all the same, the first line segments that are arranged within the area group all become parallel to one another. That means that the connecting of the line segments for each of the first line segment colors can be controlled over a wide range, so the sewn quality of the first stitches that are ultimately formed can be improved.

Third Embodiment

Figure 24:
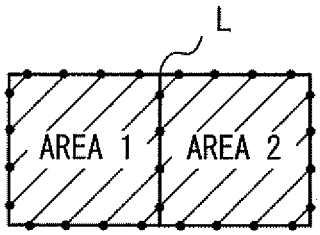
FIG. 24 is an explanatory figure that shows an example in which the first line segments have been arranged in an area 1 and an area 2, respectively.

In the first data creation processing according to the second embodiment (refer to FIG. 12), the first line segments are arranged for each of the color areas (Step S16). According to this processing, in a case where the boundary lines between a plurality of color areas that have been set as connectable to one another are parallel to the representative angle, as shown in FIGS. 21 to 23 for the specific example that was described above, the first line segments can be connected across the plurality of the color areas without any interference by the boundary lines. In contrast, in a case where the representative angles for an area 1 and an area 2 that can be connected to one another are both 45 degrees, as shown in FIG. 24, for example, and a boundary line L between the two areas extends in the 90-degree direction, not parallel to the 45-degree representative angle, endpoints of the first line segments that are arranged in the area 1 and endpoints of the first line segments that are arranged in the area 2 are set on the boundary line L. In this case, a situation may occur in which the first line segments in the lower right corner of the area 1 and the upper left corner of the area 2 become too short, such that it becomes difficult to form the first stitches there.

Accordingly, in a third embodiment, processing is performed that, instead of arranging the first line segments for each of the color areas, arranges the first line segments by treating a plurality of color areas that can be connected to one another in the same manner as a single color area. The first data creation processing according to the third embodiment will be explained with reference to FIGS. 25 and 26. Note that the first data creation processing according to the third embodiment modifies only a portion of the first data creation processing and the area connection processing according to the second embodiment that were explained with reference to FIGS. 12 and 13. Accordingly, for the parts where the processing is the same, the same step numbers will be assigned, and the explanations will be omitted, while only the modified portions will be explained.

Figure 25:
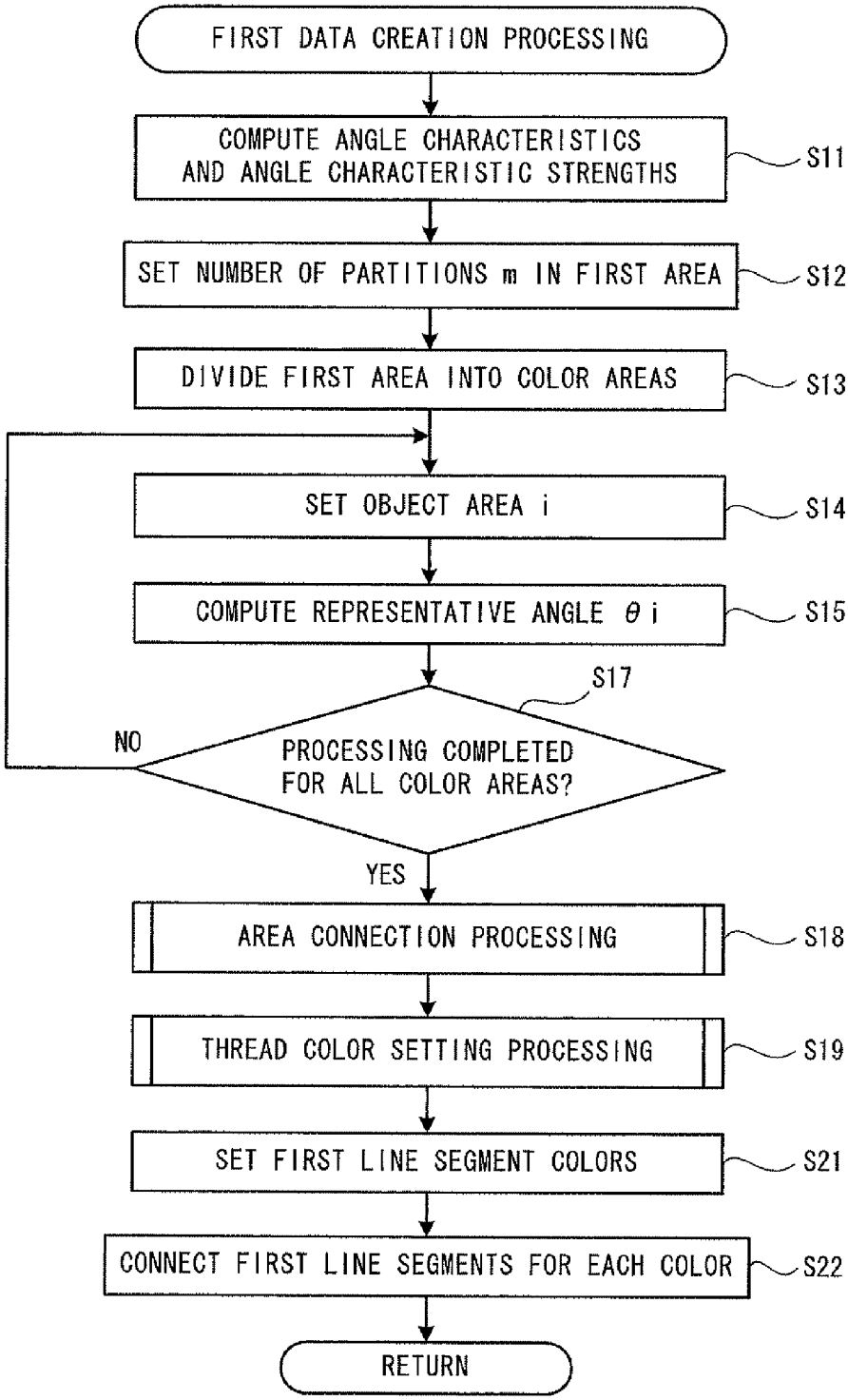
FIG. 25 is a flowchart of the first data creation processing according to a third embodiment.
Figure 26:
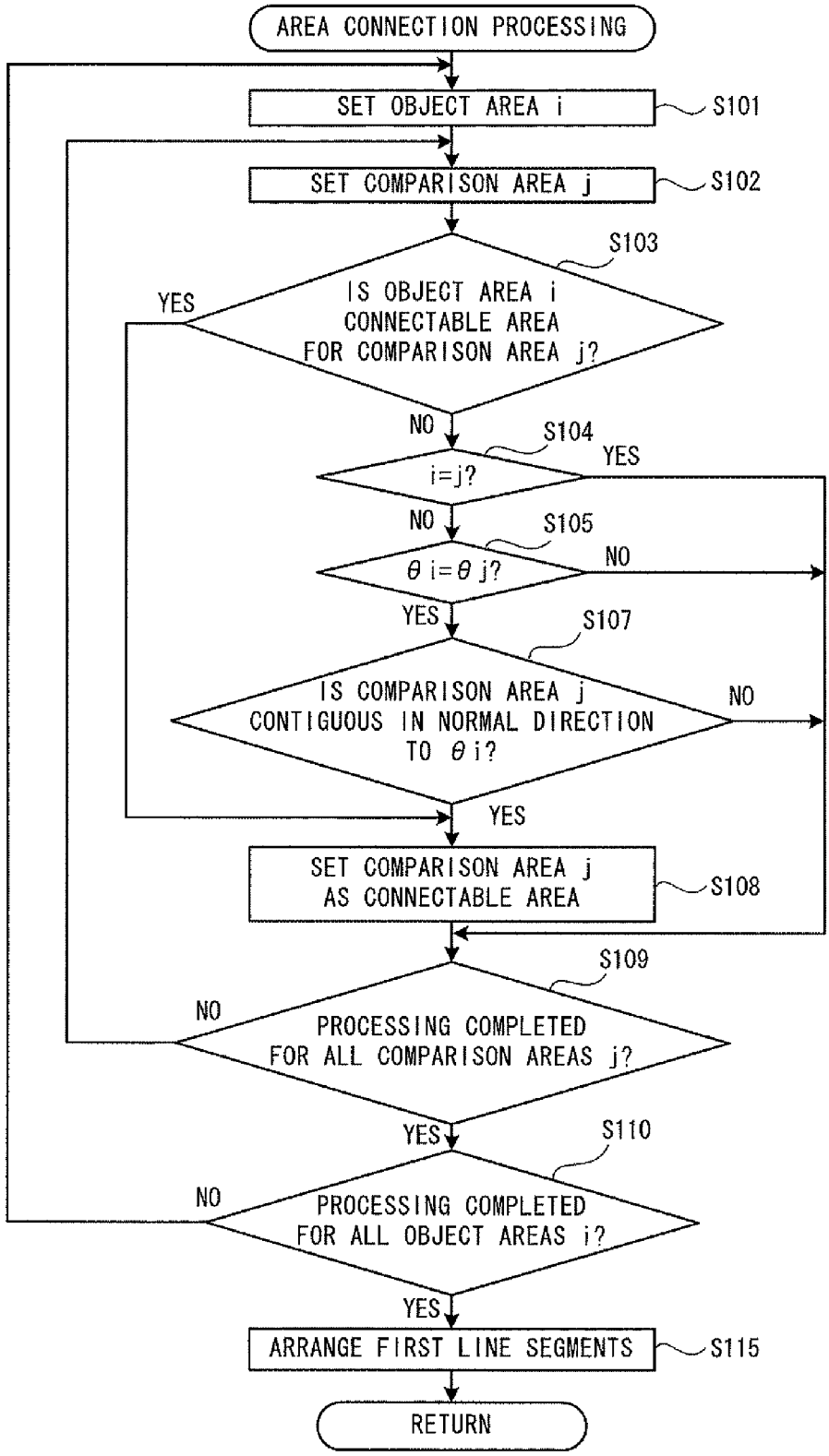
FIG. 26 is a flowchart of the area connection processing according to the third embodiment.

As shown in FIG. 25, in the third embodiment, the first line segment arranging processing (Step S16 in FIG. 12) that was performed for each of the color areas in the second embodiment is not performed. Instead, as shown in FIG. 26, after the processing that sets the color areas that satisfy the specified conditions as the connectable areas is performed for all of the color areas (Steps S101 to S110), in the same manner as in the second embodiment, processing is performed that arranges the first line segments for each of the color areas and for each of the connectable area groups (Step S115). Specifically, the matrix that has been stored in the RAM 12 is referenced, and for any color area for which the connectable area has not been set, the first line segments are arranged for that color area in the same manner as in the second embodiment that was described above. For the color areas for which the connectable areas have been set, the first line segments are arranged by treating all of the connectable color areas, that is, the connectable area group, as a single color area.

Figure 27:
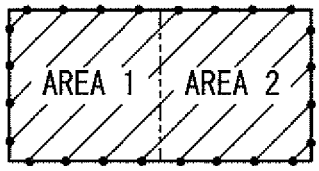
FIG. 27 is an explanatory figure that shows an example in which the first line segments have been arranged with the area 1 and the area 2 regarded as a single color area.

Therefore, the endpoints of the first line segments are not set on the boundary line between the area 1 and the area 2, as shown in FIG. 27, for example, which makes it possible to prevent first line segments that are too short from being arranged in the corners of the area 1 and the area 2. Thus, according to the first data creation processing according to the third embodiment, the first line segments are arranged by treating the connectable area group as a single color area. Therefore, the possibility that the sewn quality will be impaired, because the first line segments are too short due to the shapes of the color areas, can be reduced.

Fourth Embodiment

In the third embodiment, any two of the color areas are treated as a connectable area group that is equivalent to a single color area, only in a case where the representative angles for these color areas are the same and one of the color areas is contiguous with the other color area in the normal direction to the representative angle for the other color area. In other words, in a case where the representative colors for the two color areas are merely close to one another, but not the same, these color areas will not be set as a connectable area group, even though one of the color areas is contiguous with the other color area in the normal direction of the representative angle for the other color area. In this case, the first line segments that are close to the boundary lines of the color areas may become too short.

Accordingly, in a fourth embodiment, for any two of the color areas, if the representative angles for the color areas are not the same, but are within a specified range from one another and if one of the color areas is contiguous with the other color area in the normal direction to the representative angle for the other color area, the color areas will be set as a connectable area group, and the processing that arranges the first line segments will be performed such that the connectable area group is treated as being equivalent to a single color area. Hereinafter, the first data creation processing according to the fourth embodiment will be explained with reference to FIG. 28. Note that the first data creation processing according to the fourth embodiment modifies only a portion of the area connection processing according to the third embodiment that was explained with reference to FIG. 26. Accordingly, for the parts where the processing is the same, the same step numbers will be assigned, and the explanations will be omitted, while only the modified portion will be explained.

Figure 28:
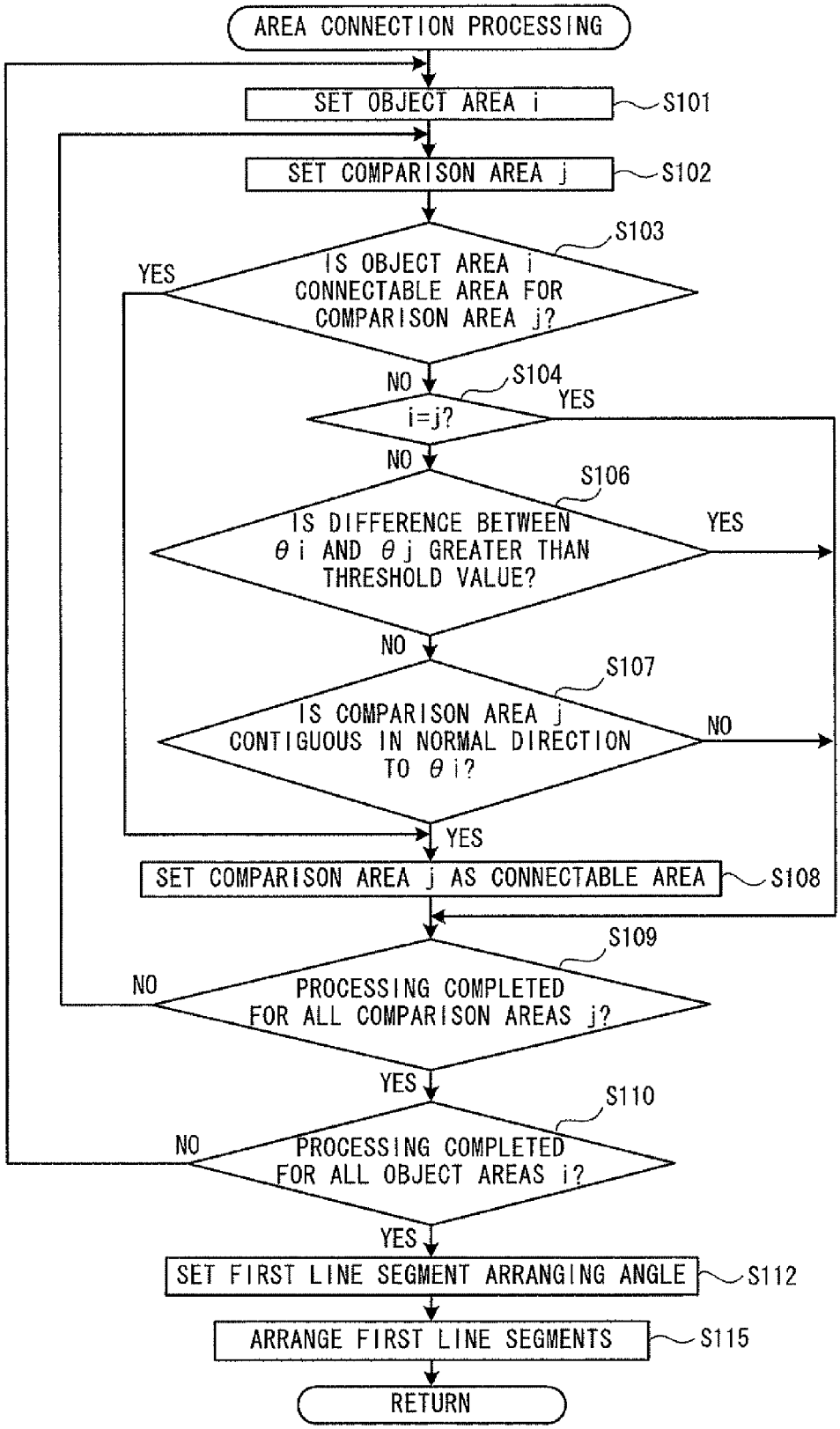
FIG. 28 is a flowchart of the area connection processing according to a fourth embodiment.

In contrast to the determination that is made in the processing according to the third embodiment that is shown in FIG. 26 as to whether the representative angle θi for the object area i and the representative angle θj for the comparison area j are the same (Step S105), in the fourth embodiment, as shown in FIG. 28, a determination is made as to whether the representative angle θj is within a specified range from the representative angle θi (Step S106). Specifically, a determination is made as to whether a difference between the representative angle θi and the representative angle θj is greater than a specified threshold value (for example, five degrees). A value that has been set in advance and stored in the setting values storage area 154 of the HDD 15 may be used as the specified threshold value. A value that has been input by the user may also be used. In a case where the difference between the representative angles is greater than a specified threshold value (YES at Step S106), the comparison area j is not set as a connectable area for the object area i. In a case where the difference between the representative angles is not greater than the specified threshold value (NO at Step S106), the comparison area j is set as a connectable area for the object area i if the comparison area j is contiguous with the object area i in the normal direction to the representative angle θi (YES at Step S107; Step S108).

When all of the color areas have been set as the object area i and the processing that sets the connectable areas has been completed (YES at Step S110), an angle at which the first line segments will be arranged within each of the connectable area groups that have been set (hereinafter called the first line segment arranging angle) is set (Step S112). Specifically, the matrix that has been stored in the RAM 12 is referenced, and the connectable area groups are specified. The first line segment arranging angle is set based on the representative angles for the plurality of the color areas that are included in the connectable area group that has been specified. If the representative angles for the color areas are all the same, that angle is defined as the first line segment arranging angle. In a case where the representative angles are different, the average value of the representative angles for the color areas may be used as the first line segment arranging angle, for example. Alternatively, the representative angle for the color area that includes the largest number of pixels (that has the largest surface area) of any of the color areas may be defined as the first line segment arranging angle. Note that in a case where no connectable areas have been set in the processing at Steps S101 to S110, the processing at Step S112 may be omitted.

Next, processing is performed that arranges the first line segments for each of the color areas and for each of the connectable area groups, in the same manner as in the third embodiment (Step S115). Accordingly, processing is performed that arranges the first line segments by treating as a single color area the plurality of the color areas that have been set as the connectable area group, that are contiguous with one another in the normal direction to the representative angle, and that have representative angles that are not the same but are similar. After the first line segments have been arranged, the area connection processing is terminated. Next, after the used thread colors have been set in the thread color setting processing such that the connectable area groups can be sewn with the minimum number of thread colors, the first line segment colors are set by referencing the color of the original image, and the first line segments are connected for each of the first line segment colors (Steps S19, S21, and S22 in FIG. 25).

According to the first data creation processing according to the fourth embodiment, two color areas are treated as a single color area if one of the color areas is contiguous with the other color area, and if the representative angles for the color areas are within a specified range from one another, even if they are not the same. The first line segments are arranged according to the first line segment arranging angle that is set based on representative angles of the color areas. Therefore, the possibility that the sewn quality will be impaired, because the first line segments are too short due to the shapes of the color areas, can be reduced even more. Furthermore, the conditions for setting the connectable areas are loosened, and a larger number of the color areas can be included in the connectable area groups. Therefore, in the processing that is performed after the area connection processing, the connecting of the first line segments for each of the first line segment colors can be controlled over a wider range, making it possible to improve the sewn quality.

Fifth Embodiment

In the fourth embodiment, for any two color areas, if one of the color areas is contiguous with the other color area in the normal direction to the representative angle for the other color area, and if the representative angles for the color areas are not the same, but are within a specified range from one another, the color areas are set as a connectable area group and treated as being equivalent to a single color area. In a fifth embodiment, in this sort of case, an intermediate area is set between the contiguous areas, a connectable area group is set that also includes the intermediate area, and the processing is performed that arranges the first line segments. The first data creation processing according to the fifth embodiment will be explained with reference to FIG. 29. Note that the first data creation processing according to the fifth embodiment modifies only a portion of the area connection processing according to the fourth embodiment that was explained with reference to FIG. 28. Accordingly, for the parts where the processing is the same, the same step numbers will be assigned, and the explanations will be omitted, while only the modified portion will be explained.

Figure 29:
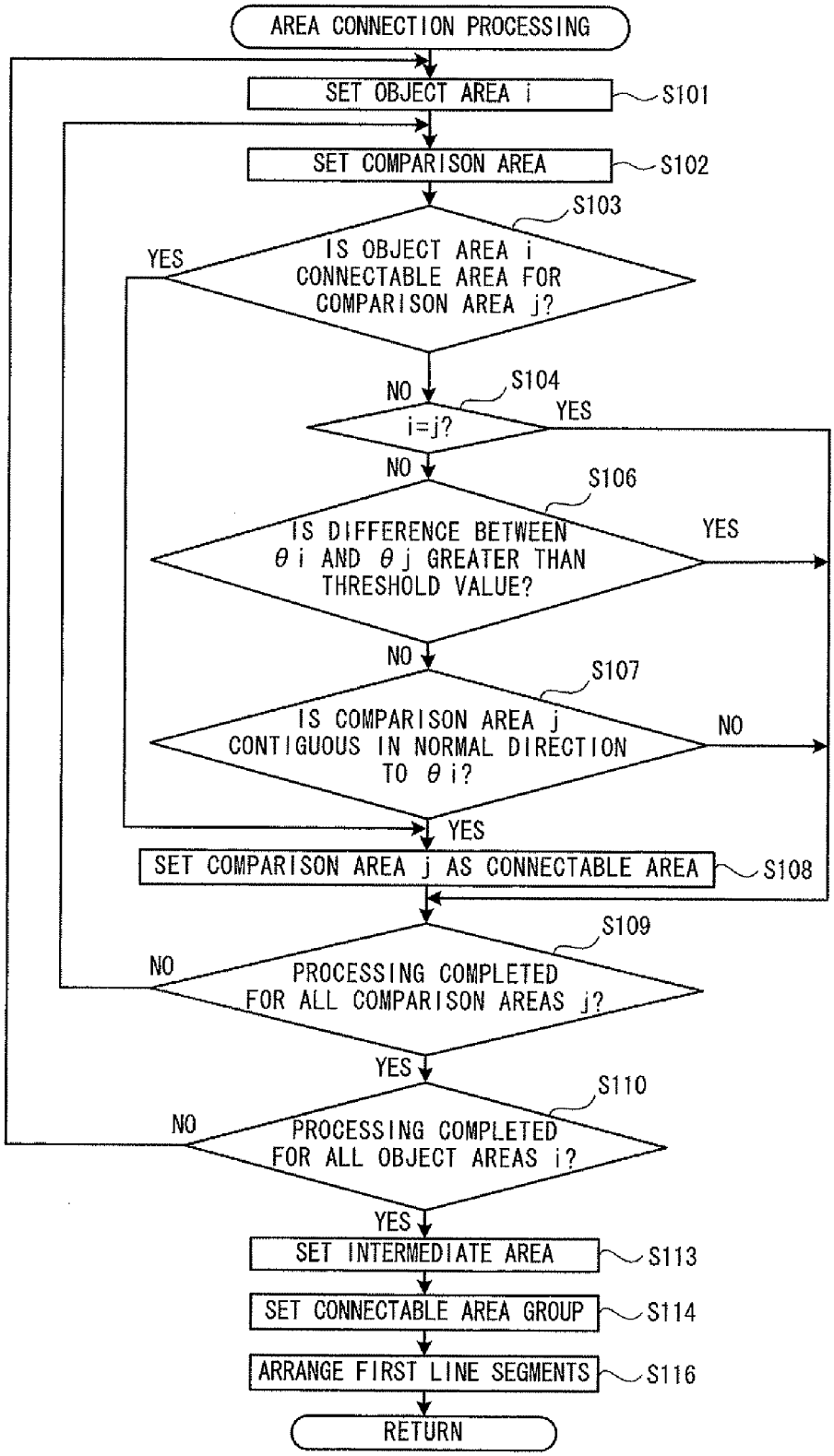
FIG. 29 is a flowchart of the area connection processing according to a fifth embodiment.

As shown in FIG. 29, in the fifth embodiment as well, in a case where the difference between the representative angle θi and the representative angle θj is not greater than the specified threshold value (for example, five degrees) (NO at Step S106), the comparison area j is set as a connectable area for the object area i if the comparison area j is contiguous with the object area i in the normal direction to the representative angle θi (YES at Step S107; Step S108). When all of the color areas have been set as the object area i and the processing that sets the connectable areas has been completed (YES at Step S110), in a case where the representative angles of two contiguous color areas within the connectable area group are different, processing is performed that sets the intermediate area between the two color areas (Step S113). In a case where the two mutually connectable color areas are an area 1 and an area 2, and their respective representative angles are θ1 and θ2, an intermediate area 1-2 is set as an area that has a straight line at the angle θ1 and a straight line at the angle θ2 as boundary lines, and for which the representative angle is an angle that is intermediate between the angle θ1 and the angle θ2.

If the area 2 is contiguous with the area 1 in a direction of (θ1−90) degrees, which is the normal direction to the representative angle θ1 for the area 1, the intermediate area 1-2 can be set by the method hereinafter described, for example. First, a virtual line L1 that passes through any given pixel in the area 1 is drawn at the angle θ1. In a case where L1 passes through the area 2, L1 is shifted by one pixel in a direction of (θ1−90+180) degrees. The same processing is repeated until L1 no longer passes through the area 2. L1 at the point in time when it ceases to pass through the area 2 is set as the boundary line between the area i and the intermediate area 1-2. On the other hand, in a case where the virtual line L1 does not pass through the area 2, L1 is shifted by one pixel in a direction of (θ1−90) degrees. The same processing is repeated until L1 passes through the area 2. L1 at the point immediately before it passes through the area 2 is set as the boundary line between the area 1 and the intermediate area 1-2.

In the same manner, a virtual line L2 that passes through any given pixel in the area 2 is drawn at the angle θ2. In a case where L2 passes through the area 1, L1 is shifted by one pixel in a direction of (θ2+90−180) degrees. The same processing is repeated until L2 no longer passes through the area 1. L2 at the point in time when it ceases to pass through the area 1 is set as the boundary line between the area 2 and the intermediate area 1-2. On the other hand, in a case where the virtual line L2 does not pass through the area 1, L2 is shifted by one pixel in a direction of (θ1+90) degrees. The same processing is repeated until L2 passes through the area 1. L2 at the point immediately before it passes through the area 1 is set as the boundary line between the area 2 and the intermediate area 1-2. Thus, between the area 1 and the area 2, the area that is demarcated by L1 and L2 is set as the intermediate area 1-2. A representative angle θM for the intermediate area 1-2 may be defined as an angle of the sum of two vectors of equal magnitude, one at the representative angle θ1 of the area 1 and the other at the representative angle θ2 of the area 2.

When the intermediate area 1-2 is set in this manner, the three areas, that is, the area 1, the intermediate area 1-2, and the area 2, are set as the connectable area group (Step S114). For example, a row and a column that indicate the intermediate area 1-2 may be added to the matrix of the object areas i and the comparison areas j, and the intermediate area 1-2 may be set as a connectable area for the color areas that correspond to the area 1 and the area 2. Note that in a case where no connectable areas at all have been set in the processing at Steps S101 to S110, the processing at Steps S113 to S114 may be omitted.

Next, the first line segments are arranged in the color areas and the intermediate area according to the representative angles for the respective areas (Step S116). For example, in the area 1, the intermediate area 1-2, and the area 2, which are the connectable area group that includes the intermediate area, the first line segments are arranged that extend in the directions of the representative angles θ1, θM, and θ2, respectively, and have their endpoints on the boundary lines of the respective areas. After the first line segments have been arranged, the area connection processing is terminated. Next, after the used thread colors have been set in the thread color setting processing such that the connectable area groups can be sewn with the minimum number of thread colors, the first line segment colors are set by referencing the color of the original image, and the first line segments are connected for each of the first line segment colors (Steps S19, S21, and S22 in FIG. 25).

According to the first data creation processing according to the fifth embodiment, an intermediate area is set between two color areas if one of the color areas is contiguous with the other color area, and if the representative angles for the color areas are within a specified range from one another, even if they are not the same. The intermediate area has as its representative angle an angle characteristic that is between the representative angles of the two color areas. Then the connectable area group is set that includes the intermediate area. In the same manner as in the fourth embodiment, the conditions for setting the connectable areas are loosened, and a larger number of the color areas are included in the connectable area groups. Therefore, the connecting of the first line segments for each of the first line segment colors can be controlled over a wider range, making it possible to improve the sewn quality. The representative angle for the intermediate area is an angle that is intermediate between the representative angles for the two original contiguous color areas, so natural stitches can be formed that more appropriately reflect the angle characteristics of the original image.

The present disclosure is not limited to the embodiments that have been described above, and various types of modifications can be made. For example, the method for creating the second data for the second area may be different from the method for creating the first data and is not limited to the method that arranges the first line segments based on the angle characteristic for each pixel and its strength, as in the embodiments. For example, if the second area has a shape that is equivalent to a contour line of the design, the second data may be created for sewing running stitches, zigzag stitches, or the like on at least one line that follows the contour line. It is also not absolutely necessary for the colors of the second line segments to be set with reference to the color of each pixel in the original image or to the second line segment colors that have already been set. The second area is considered to be an area in which the change in the color is relatively abrupt, a portion where the demarcation (the edge) between the two areas can be clearly recognized when a human being looks at it with his eyes. Accordingly, the second line segment color for all of the second line segments may be set to the one color black, for example. In that case, the embroidery pattern can be produced with a clearer demarcation between the areas.

In the embodiments, the second data are linked after the first data, such that the second line segments will be sewn after the first line segments. However, it is not absolutely necessary for the first data and the second data to be linked in that order. The first data may also be linked after the second data.

In the first embodiment, the first line segment colors are set as the colors that are the closest to the colors of the color areas, but they may also be set by a method that sets them by referencing the colors of the original image and the first line segment colors that have already been set, in the same manner as in the second embodiment and the like.

The connectable area groups may also be set by a method other than the method that was used as examples in the second to the fifth embodiments. For example, in a case where a given color area is contiguous with a different color area that does not have a representative angle, the two color areas may be set as a connectable area group in which the representative angle for the color area that does not have a representative angle is set to the same angle as the representative angle for the contiguous color area. Furthermore, in a case where a color area that does not have a representative angle is contiguous with a plurality of color areas that do have representative angles, the representative angle for the color area that has the greatest amount of contiguousness with the color area that does not have a representative angle may be used as the representative angle.

In the embodiments, when the usable thread colors are set, only single colors and mixed colors that are mixtures of two colors are used as candidates, but mixed colors that are mixtures of more than two colors may also be used as candidates. Furthermore, it is assumed that the mixed color that is a mixture of two colors expresses the representative color of the color area by combining the individual colors in a 1-to-1 ratio, but the use ratio may also be changed, such as to 2-to-3, for example. In that case, the RGB values for the mixed color may be computed based on weighting by the use ratio, and a determination may be made as to whether the representative color of the color area can be expressed.

In the embodiments, the surface area of the color area is not taken into account in the computation of the use frequency for each of the usable thread colors. In a case where the surface areas differ, the computation may be performed by weighting according to the surface area ratio. The distance in the RGB space between the representative color of the color area and a candidate color may also be used for weighting.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data creation apparatus that creates embroidery data based on image data for an image that is an aggregation of pixels, the embroidery data creation apparatus comprising:

a first dividing portion that divides an entire area of the image into a first area and a second area, based on one of frequency components and angle characteristics that make up the image, the angle characteristic being information that indicates a direction in which continuity of a color within the image is high, the first area being an area within the entire area that is not the second area, and the second area being, within the entire area of the original image, one of an area that contains frequency components that are not less than a specified value and an area that has angle characteristics each having a strength that is not less than a specified value, the strength indicating a magnitude of change in a color;

a first data creation portion that creates first data, the first data being data that describe first stitches, the first stitches being stitches to be formed in the first area, the first data creation portion including a number of partitions setting portion that sets a number of partitions for dividing the first area by color, a second dividing portion that divides the first area into color areas by reducing the number of colors in the first area to the number of partitions that has been set by the number of partitions setting portion, in accordance with colors of pixels that make up the first area, a representative angle computing portion that computes a representative angle for each of the color areas, the representative angle being a representative angle characteristic for the color area, a first line segment arranging portion that arranges first line segments in each of the color areas in accordance with the representative angle that has been computed by the representative angle computing portion, the first line segments being line segments that correspond to the first stitches, a first line segment color setting portion that sets first line segment colors from among thread colors that can be used by a sewing machine, the first line segment colors being thread colors to be used for the respective first line segments, and a first line segment connecting portion that creates the first data by connecting the first line segments for each of the first line segment colors that have been set by the first line segment color setting portion;

a second data creation portion that creates second data by a method that is different from the method for creating the first data, the second data being data that describe second stitches, the second stitches being stitches to be formed in the second area; and an embroidery data creation portion that, by combining the first data that have been created by the first data creation portion and the second data that have been created by the second data creation portion, creates embroidery data for sewing an embroidery pattern that expresses the image.

2. The embroidery data creation apparatus according to claim 1, wherein the first line segment color setting portion sets the first line segment colors based on the colors that respectively correspond to the color areas that have been defined by the second dividing portion.

3. The embroidery data creation apparatus according to claim 2, wherein the first data creation portion further includes an area group setting portion that sets one color area and another color area as an area group in which color areas are connectable to one another among the color areas, at least in a case where the one color area is contiguous with the other color area in a normal direction to the representative angle of the other color area, and the representative angle of the one color area is the same as the representative angle of the other color area, and the first line segment color setting portion includes a first setting portion that sets, from among the thread colors that can be used by the sewing machine, one or more usable thread colors for each of the color areas that have been defined by the second dividing portion, the one or more usable thread colors being one or more thread colors that can express the color that corresponds to each of the color areas, a second setting portion that sets used thread colors from among a total of the usable thread colors that have been set for the color areas by the first setting portion, the used thread colors being thread colors to be actually used in sewing and including a minimum number of usable thread colors for the area group that can express the colors of the entire area group and one or more usable thread colors for the color area that is not included in the area group that can express the color of the color area, the minimum number of usable thread colors being set based on frequencies with which the individual usable thread colors that have been set for the area group can be used in the area group, and a third setting portion that, based on the image data, sets each of the first line segment colors for each of the first line segments to one of the used thread colors that have been set by the second setting portion.

4. The embroidery data creation apparatus according to claim 3, wherein the first line segment arranging portion, in a case where the area group has been set by the area group setting portion, arranges the first line segments by treating the area group as a single color area.

5. The embroidery data creation apparatus according to claim 4, wherein the area group setting portion sets one color area and another color area as the area group among the color areas, also in a case where the one color area is contiguous with the other color area in the normal direction to the representative angle of the other color area, and the representative angle of the one color area is within a specified range from the representative angle of the other color area, and the first line segment arranging portion arranges the first line segments in the area group that is treated as the single color area, in accordance with an angle characteristic that is computed based on the representative angle for the one color area and the representative angle for the other color area.

6. The embroidery data creation apparatus according to claim 3, wherein the first data creation portion further includes an intermediate area setting portion that sets an intermediate area between one color area and another color area among the color areas, in a case where the one color area is contiguous with the other color area in the normal direction to the representative angle of the other color area, and the representative angle of the one color area is within a specified range from the representative angle of the other color area, the intermediate area having boundary lines in accordance with the representative angle for the one color area and the representative angle for the other color area and having as a representative angle an angle characteristic that is between the representative angle for the one color area and the representative angle for the other color area, the area group setting portion, in a case where the intermediate area has been set by the intermediate area setting portion, sets the one color area, the intermediate area, and the other color area as the area group, and the first line segment arranging portion arranges the first line segments in each of the color areas and in the intermediate area in accordance with the respective representative angles.

7. The embroidery data creation apparatus according to claim 1, wherein the second data creation portion includes a second line segment arranging portion that arranges second line segments in the second area based on the angle characteristics that have been computed for respective pixels that make up the second area and on the strengths of the angle characteristics, the second line segments being line segments that correspond to the second stitches, a second line segment color setting portion that, based on the image data, sets second line segment colors from among thread colors that can be used by a sewing machine, the second line segment colors being thread colors to be used for the respective second line segments, and a second line segment connecting portion that creates the second data by connecting the second line segments for each of the second line segment colors that have been set by the second line segment color setting portion.

8. The embroidery data creation apparatus according to claim 1, wherein the embroidery data creation portion combines the first data and the second data such that a sewing order for the second stitches comes after a sewing order for the first stitches.

9. A non-transitory computer-readable medium that stores an embroidery data creation program for creating embroidery data based on image data for an image that is an aggregation of pixels, the embroidery data creation program comprising instructions that, when executed, cause a computer to perform the steps of:

dividing an entire area of the image into a first area and a second area, based on one of frequency components and angle characteristics that make up the image, the angle characteristic being information that indicates a direction in which continuity of a color within the image is high, the first area being an area within the entire area that is not the second area, and the second area being, within the entire area of the original image, one of an area that contains frequency components that are not less than a specified value and an area that has angle characteristics each having a strength that is not less than a specified value, the strength indicating a magnitude of change in a color;

setting a number of partitions for dividing the first area by color;

dividing the first area into color areas by reducing the number of colors in the first area to the number of partitions that has been set, in accordance with colors of pixels that make up the first area;

computing a representative angle for each of the color areas, the representative angle being a representative angle characteristic for the color area;

arranging first line segments in each of the color areas in accordance with the representative angle that has been computed, the first line segments being line segments that correspond to first stitches, the first stitches being stitches to be formed in the first area;

setting first line segment colors from among thread colors that can be used by a sewing machine, the first line segment colors being thread colors to be used for the respective first line segments;

creating first data by connecting the first line segments for each of the first line segment colors that have been set, the first data being data that describe the first stitches;

creating second data by a method that is different from the method for creating the first data, the second data being data that describe second stitches, the second stitches being stitches to be formed in the second area; and creating, by combining the first data and the second data, embroidery data for sewing an embroidery pattern that expresses the image.

10. The computer-readable medium according to claim 9, wherein the first line segment colors are set based on the colors that respectively correspond to the color areas that have been defined by reducing the number of the colors in the first area.

11. The computer-readable medium according to claim 10, wherein the embroidery data creation program further includes instructions to cause the computer to perform a step of:

setting, at least in a case where, among the color areas, one color area is contiguous with another color area in a normal direction to the representative angle of the other color area, and the representative angle of the one color area is the same as the representative angle of the other color area, the one color area and the other color area as an area group in which color areas are connectable to one another, and setting the first line segment colors includes setting, from among the thread colors that can be used by the sewing machine, one or more usable thread colors for each of the color areas that have been defined, the one or more usable thread colors being one or more thread colors that can express the color that corresponds to each of the color areas, setting used thread colors from among a total of the usable thread colors that have been set for the color areas, the used thread colors being thread colors to be actually used in sewing and including a minimum number of usable thread colors for the area group that can express the colors of the entire area group and one or more usable thread colors for the color area that is not included in the area group that can express the color of the color area, the minimum number of usable thread colors being set based on frequencies with which the individual usable thread colors that have been set for the area group can be used in the area group, and setting, based on the image data, each of the first line segment colors for each of the first line segments to one of the used thread colors that have been set.

12. The computer-readable medium according to claim 11, wherein the first line segments are arranged by treating the area group as a single color area in a case where the area group has been set.

13. The computer-readable medium according to claim 12, wherein one color area and another color area are set as the area group among the color areas, also in a case where the one color area is contiguous with the other color area in the normal direction to the representative angle of the other color area, and the representative angle of the one color area is within a specified range from the representative angle of the other color area, and the first line segments in the area group that is treated as the single color area are arranged in accordance with an angle characteristic that is computed based on the representative angle for the one color area and the representative angle for the other color area.

14. The computer-readable medium according to claim 11, wherein the embroidery data creation program further includes instructions to cause the computer to perform a step of:

setting an intermediate area between one color area and another color area among the color areas, in a case where the one color area is contiguous with the other color area in the normal direction to the representative angle of the other color area, and the representative angle of the one color area is within a specified range from the representative angle of the other color area, the intermediate area having boundary lines in accordance with the representative angle for the one color area and the representative angle for the other color area and having as a representative angle an angle characteristic that is between the representative angle for the one color area and the representative angle for the other color area, and wherein the one color area, the intermediate area, and the other color area are set as the area group, in a case where the intermediate area has been set, and the first line segments are arranged in each of the color areas and in the intermediate area in accordance with the respective representative angles.

15. The computer-readable medium according to claim 9, wherein creating the second data includes arranging second line segments in the second area based on the angle characteristics that have been computed for respective pixels that make up the second area and on the strengths of the angle characteristics, the second line segments being line segments that correspond to the second stitches, setting, based on the image data, second line segment colors from among thread colors that can be used by a sewing machine, the second line segment colors being thread colors to be used for the respective second line segments, and creating the second data by connecting the second line segments for each of the second line segment colors that have been set.

16. The computer-readable medium according to claim 9, wherein the first data and the second data are combined such that a sewing order for the second stitches comes after a sewing order for the first stitches.

* * * * *